US007023129B1

(12) United States Patent
Akiyama et al.

(10) Patent No.: US 7,023,129 B1
(45) Date of Patent: Apr. 4, 2006

(54) CATHODE-RAY TUBE AND IMAGE DISPLAY COMPRISING THE SAME

(75) Inventors: Koji Akiyama, Neyagawa (JP); Hideo Kurokawa, Katano (JP); Michiaki Watanabe, Ibaraki (JP); Toshifumi Nakatani, Moriguchi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 35 days.

(21) Appl. No.: 10/111,264

(22) PCT Filed: Oct. 20, 2000

(86) PCT No.: PCT/JP00/07358

§ 371 (c)(1),
(2), (4) Date: Aug. 2, 2002

(87) PCT Pub. No.: WO01/29864

PCT Pub. Date: Apr. 26, 2001

(30) Foreign Application Priority Data

Oct. 22, 1999 (JP) ..... 11-300949
Dec. 24, 1999 (JP) ..... 11-367171

(51) Int. Cl.
*H01J 29/80* (2006.01)

(52) U.S. Cl. ..... 313/404; 313/402; 313/406

(58) Field of Classification Search ..... 313/408, 313/404, 405, 406, 407, 402, 269, 50
See application file for complete search history.

(56) References Cited

U.S. PATENT DOCUMENTS 4,916,357 A * 4/1990 Nakamura et al. ..... 313/402
5,376,863 A * 12/1994 Kim et al. ..... 313/404
5,576,595 A * 11/1996 Inoue ..... 313/402
5,850,121 A * 12/1998 Matsudate ..... 313/402
6,054,803 A * 4/2000 Saita ..... 313/402
6,294,864 B1 * 9/2001 Mochizuki et al. ..... 313/405
6,469,431 B1 * 10/2002 Suzuki et al. ..... 313/407

FOREIGN PATENT DOCUMENTS

| | | |
|---|---|---|
| JP | 47-28191 | 7/1972 |
| JP | 55-111158 | 8/1980 |
| JP | 58-26445 | 6/1983 |
| JP | 58-47639 | 10/1983 |
| JP | 60-7151 | 1/1985 |

(Continued)

*Primary Examiner*—Edward J. Glick
*Assistant Examiner*—Elizabeth Keaney
(74) *Attorney, Agent, or Firm*—Snell & Wilmer L.L.P.

(57) ABSTRACT

A cathode ray tube includes an electron gun for emitting at least one electron beam; a mask frame include a mask having a plurality of holes or slits for allowing the electron beam to be transmitted therethrough and a frame to which the mask is attached; and a panel including a phosphor layer to be scanned by the at least one electron beam transmitted through the plurality of holes or slits of the mask. The panel includes a plurality of stud pins for supporting the frame. The frame includes a plurality of elastic supports engaged with the plurality of stud pins. At least one of the plurality of elastic supports includes an engagement portion having an engaging hole which is engaged with one of the plurality of the stud pins and an elastic portion in contact with the one stud pin. Mask frame vibration causes the elastic portion to rub against a respective stud pin so as to generate a frictional force for attenuating the vibration of the mask frame.

51 Claims, 22 Drawing Sheets

FOREIGN PATENT DOCUMENTS

| | | | |
|---|---|---|---|
| JP | 60-25812 | | 8/1985 |
| JP | 61-267239 | | 11/1986 |
| JP | 93-5633 | | 3/1993 |
| JP | 06-096682 | | 4/1994 |
| JP | 06333506 | A | 12/1994 |
| JP | 7-141995 | | 6/1995 |
| JP | 7-114113 | | 12/1995 |
| JP | 2523729 | | 5/1996 |
| JP | 09-035653 | | 2/1997 |
| JP | 2606157 | | 2/1997 |
| JP | 2537778 | | 3/1997 |
| JP | 09-293459 | | 11/1997 |
| JP | 11054061 | A | 2/1999 |
| KR | 1993-5633 | | 3/1993 |

* cited by examiner

CATHODE-RAY TUBE AND IMAGE DISPLAY COMPRISING THE SAME

TECHNICAL FIELD

The present invention relates to a cathode ray tube, specifically a cathode ray tube having a feature in an elastic support used for supporting a frame, and also relates to an image display apparatus using such a cathode ray tube, such as an image monitor used for a TV, a personal computer, an oscilloscope or the like.

BACKGROUND ART

FIG. 20A shows a structure of a conventional cathode ray tube 1900. As shown in FIG. 20A, the cathode ray tube 1900 includes a panel 1903 having a generally quadrangular container-shape. The panel 1903 includes a panel main body 1901 having an inner curved surface and a side wall 1902 provided around four sides of the panel main body 1901. The cathode ray tube 1900 further includes a funnel 1904 joined to the side wall 1902.

On an inner surface of the panel 1903, a phosphor screen 1905 including a three color phosphor layer of RGB color elements (red, green and blue) is provided. A mask frame 1909 is provided to face the phosphor screen 1905. The mask frame 1909 includes a generally quadrangular frame 1908 and a mask (shadow mask) 1907 attached to the frame 1908 so as to extend over the frame 1908. The mask 1907 is generally quadrangular and has a plurality of electron beam transmission holes or slits 1906.

The funnel 1904 includes a neck 1910, which accommodates an electron gun 1912 for emitting three electron beams 1911. A color image is displayed as follows. The three electron beams 1911 emitted by the electron gun 1912 are deflected by a magnetic field generated by a deflection device 1913 provided on an outer surface of the funnel 1904, and the phosphor screen 1905 is horizontally and vertically scanned with the three electron beams 1911 through the mask frame 1909. In FIG. 20A, reference numeral 1906 represents an inner magnetic shield attached to the frame 1908. In order to display an accurate color image on the phosphor screen 1905 in the cathode ray tube 1900 having the above-described structure, the mask frame 1909 needs to be kept aligned at a prescribed relationship with respect to the three color phosphor layer included in the phosphor screen 1905.

FIG. 20B is a cross-sectional view of the cathode ray tube 1900 shown in FIG. 20A taken along line A—A in FIG. 1. As shown in FIG. 20B, a known system for supporting the mask frame 1909 includes generally V-shaped elastic supports 1914 respectively attached to four corners of the frame 1908 and stud pins 1915 respectively provided on the four corners of the side wall 1902 of the panel 1903. The mask frame 1909 is detachably supported to the panel 1903 by engaging the elastic supports 1914 with the stud pins 1915 respectively.

FIG. 21A shows a structure of another conventional cathode ray tube 2000. FIG. 21B is across-sectional view of the cathode ray tube 2000 shown in FIG. 20A taken along line B—B in FIG. 21A. Identical elements previously discussed with respect to FIGS. 20A and 20B bear identical reference numerals and the descriptions thereof will be omitted. As shown in FIG. 21B, another known system for supporting the mask frame 1909 includes strip-like elastic supports 2001 respectively attached to centers of four sides of the frame 1908 and stud pins 1915 respectively provided at centers of four inner faces of the side wall 1902 of the panel 1903. The mask frame 1909 is detachably supported to the panel 1903 by engaging the elastic supports 2001 with the stud pins 1915 respectively. This system is generally known.

In general, in order to display a color image with no degradation of color purity on a phosphor screen of a cathode ray tube, it is necessary that the three electron beams 1911 transmitted through the holes 1906 formed in the mask 1907 (shadow mask) of the mask frame 1909 should accurately land on respective color areas of the three color phosphor elements of the phosphor screen 1905. In order to realize this state, the positional relationship between the panel 1903 and the mask frame 1909 needs to be kept at a prescribed relationship. Particularly, the distance (q value) between the inner surface of the panel main body 1901 on which the phosphor screen 1905 is provided and a surface of the mask 1907 facing the panel main body 1901 (shadow mask surface) needs to be kept within a prescribed tolerance.

In the state where a cathode ray tube (cathode ray tube 2000, for example) is incorporated in a set such as a TV or an image monitor, vibration from a speaker built into the set or vibration from outside the set is transferred to the cathode ray tube through a cabinet of the set, which undesirably causes the frame 1908 and the mask 1907 to also vibrate through resonance. When the vibration amplitude of the frame 1908 and the mask 1907 exceeds the prescribed tolerance of the q value, the three electron beams 1911 land on offset positions and degradation of color purity occurs. As a result, the image quality is deteriorated.

In addition, when the frame 1908 and the mask 1907 vibrate in the planar direction thereof to the extent that one of the transmission holes 1906 of the mask 1907 reaches an adjacent transmission hole 1906, the three electron beams 1911 do not accurately land on the phosphor layer of the phosphor screen 1905 (mislanding).

In order to restrict the vibration of the mask 1907 and the frame 1908 caused by the vibration transferred from outside the cathode ray tube (cathode ray tube 2000, for example), the vibration of the frame 1908 first needs to be quickly stopped. The reason for this is that unless the frame 1908 stops vibrating, the mask 1907 fixed to the frame 1908 does not stop vibrating. The inside of the cathode ray tube 2000 is in vacuum and the vibration is not attenuated by friction with air. Therefore, the mask 1907 and the frame 1908 are likely to keep vibrating for an extended period of time inside the cathode ray tube 2000. Accordingly, in order to restrict the vibration, it is necessary to provide a structure to cause friction by the vibration inside the cathode ray tube 2000 so that vibration energy is converted into friction energy.

FIGS. 22A, 22B and 22C show a specific structure of the elastic support 1914 shown in FIGS. 20A and 20B, which is disclosed in Japanese Laid-Open Publication No. 9-293459. The elastic support 1914 includes a fixing portion 2101 to be fixed to the frame 1908, an engagement portion 2102 having an engaging hole 2104 for engagement with the stud pin 1915 (FIGS. 20A and 20B), and connection portions 2103*a* and 2103*b* for connecting the fixing portion 2101 and the engagement portion 2102. The connection portions 2103*a* and 2103*b* are fixed to each other at a welding point 2107 by welding. The elastic support 1914 further includes plate-like bent portions 2105 perpendicularly raised from the fixing portion 2101 and slits 2106 made in the engagement portion 2102 for receiving the bent portions 2105. When the stud pin 1915 is engaged with the engaging hole 2104, the bent portions 2105 are inserted through the slits 2106. Due to such a structure, when the frame 1908 vibrates, the bent portions 2105 cause friction with inner surfaces of the slits 2106, and thus vibration energy is converted to friction energy. Thus, the vibration of the frame 1908 is restricted.

FIGS. 23A and 23B show a specific structure of the elastic support 2001 shown in FIGS. 21A and 21B, which is disclosed in Japanese Laid-Open Publication No. 9-35653. The elastic support 2001 includes a plurality of leaf springs having an identical shape (two leaf springs 2002 and 2003 in the example shown in FIGS. 23A and 23B), and is provided in the vicinity of a center of each of the four sides of the frame 1908 as shown in FIG. 21B. When the frame 1908 vibrates due to vibration externally applied, the elastic support 2001 is deformed and thus friction is caused between the leaf springs 2002 and 2003. Accordingly, the vibration of the frame 1908 is rapidly attenuated. FIG. 23B shows how the elastic support 2001 is engaged with the stud pin 1915.

The elastic support 1914 shown in FIGS. 22A, 22B and 22C has the following problem.

When the frame 1908 vibrates, both of two surfaces of the bent portions 2105 cause friction with inner surfaces of the slits 2106. Accordingly, the vibration is rapidly attenuated. However, when two surfaces perpendicular to each other (surfaces of the bent portions 2105 and the inner surfaces of the slits 2106) rub against each other, the sliding surfaces need to be highly smooth. Otherwise, the surfaces are easily locked by each other. Especially the inner space of the cathode ray tube, which is in high vacuum, has a friction coefficient larger than that in the outside air. Accordingly, there is a high possibility that the surfaces of the bent portions 2105 and the inner surfaces of the slits 2106 are locked by each other so as to be unmovable. Once the bent portions 2105 and the slits 2106 become unmovable, the elastic support 1914 cannot provide its original function. That is, when the electron beams 1911 (FIGS. 20A and 20B) hit the mask 1907 to raise the temperature of the mask 1907 and the mask 1907 expands while the cathode ray tube 1900 is in operation, the elastic support 1914 cannot adjust the position of the frame 1908 so as to correct the positional relationship (q value) between the inner surface of the panel main body 1901 on which the phosphor screen 1905 is provided and the surface of the mask 1907 facing the panel main body 1901 (shadow mask surface). The reason for this is that the elastic support 1914 has a mechanism of correcting the position of the frame 1908 by the elasticity of the engagement portion 2102 and the connecting portion 2103*a*.

The elastic support 2001 shown in FIGS. 23A and 23B has the following problems.

The leaf springs 2002 and 2003 having an identical shape are completely superimposed with each other. Accordingly, friction does not occur between the leaf springs 2002 and 2003 unless a force sufficiently large to deform the leaf spring 2002 is applied by the vibration. In addition, since a contact area of the leaf springs 2002 and 2003 is relatively large, the friction coefficient between the leaf springs 2002 and 2003 is large. For this reason also, the vibration of the frame 1908 cannot be restricted by the friction unless the vibration has a relatively large amplitude. Especially against the vibration in the axial direction of the cathode ray tube, the restriction effect of the elastic support 2001 is small due to a very small friction between the leaf springs 2002 and 2003. The friction is very small because the leaf springs 2002 and 2003 are likely to move in the same manner in a superimposed state due to a large friction coefficient. In actuality, when the vibration amplitude of the frame 1908 exceeds, for example, about 100 μm in the axial direction, the degradation of color purity becomes conspicuous. The leaf spring 2002 does not receive a sufficiently large force in response to such a small vibration amplitude, and thus is not deformed much. For these reasons, the elastic support 2001 does not provide a sufficient effect of restricting the vibration and is not practical for use.

The present invention has an objective of providing a cathode ray tube for rapidly attenuating vibration of a frame against vibration transferred from outside and thus preventing degradation of color purity in a color image from occurring due to mislanding of electron beams, and an image display apparatus using such a cathode ray tube.

DISCLOSURE OF THE INVENTION

A cathode ray tube according to the present invention includes an electron gun for emitting at least one electron beam; a mask frame include a mask having a plurality of holes or slits for allowing the at least one electron beam to be transmitted therethrough and a frame to which the mask is attached; and a panel including a phosphor layer to be scanned by the at least one electron beam transmitted through the plurality of holes or slits of the mask. The panel includes a plurality of stud pins for supporting the frame. The frame includes a plurality of elastic supports engaged with the plurality of stud pins. At least one of the plurality of elastic supports includes an engagement portion having an engaging hole which is engaged with one of the plurality of the stud pins and an elastic portion in contact with the one stud pin. Mask frame vibration causes the elastic portion to rub against a respective stud pin so as to generate a frictional force for attenuating the vibration of the mask frame. The above-described objective can be achieved by this structure.

In one embodiment of the invention, the one stud pin has a tip, and the elastic portion rubs against the tip of the one stud pin.

In one embodiment of the invention, the elastic portion is formed of a metal plate rolled into a cylindrical shape.

In one embodiment of the invention, the elastic portion is formed of a metal plate bent into a leaf spring-shape.

In one embodiment of the invention, the at least one elastic support includes a fixing portion for fixing the at least one elastic support to the frame, and the elastic portion is fixed to the fixing portion.

In one embodiment of the invention, the fixing portion is provided between the engagement portion and the frame.

In one embodiment of the invention, the elastic portion is provided between the engagement portion and the fixing portion.

In one embodiment of the invention, the at least one elastic support further includes a connection portion for connecting the fixing portion and the engagement portion to each other.

In one embodiment of the invention, a thickness of the fixing portion $t_0$, a thickness of the connection portion $t_1$ and a thickness of the elastic portion $t_2$ satisfy the relationships of $t_0 > t_1$ and $t_0 \geqq t_2$.

In one embodiment of the invention, a thickness of the fixing portion $t_0$, a thickness of the connection portion $t_1$ and a thickness of the elastic portion $t_2$ satisfy the relationships of $t_0 > t_1$ and $t_1 \geqq t_2$.

In one embodiment of the invention, each of the plurality of elastic supports has a substantially V-shaped cross-section.

In one embodiment of the invention, each of the plurality of elastic supports has a substantially strip-like shape.

In one embodiment of the invention, the at least one elastic support further includes a connection portion for connecting the fixing portion and the engagement portion to each other, and the elastic portion is fixed to the connection portion.

In one embodiment of the invention, the elastic portion is fixed to the engagement portion.

In one embodiment of the invention, the frame includes a pair of first shafts and a pair of second shafts shorter than the pair of first shafts, and the at least one elastic support is provided on at least one first shaft of the pair of first shafts.

In one embodiment of the invention, the frame includes a pair of first shafts and a pair of second shafts shorter than the pair of first shafts, and the at least one elastic support is provided on at least one second shaft of the pair of second shafts.

In one embodiment of the invention, the frame includes a plurality of corners, and the plurality of elastic supports are provided at respective corners.

In one embodiment of the invention, the mask includes a damper provided at an end thereof for attenuating the vibration of the mask.

In one embodiment of the invention, the electron gun includes an electric field electron emission element for reducing a cross-section of the at least one electron beam.

In one embodiment of the invention, the at least one elastic support has a bimetal structure including a first metal area formed of a first metal having a first coefficient of thermal expansion and a second metal area formed of a second metal having a second coefficient of thermal expansion which is less than the first coefficient of thermal expansion, the first metal area and the second metal being joined together.

In one embodiment of the invention, the first metal area formed of the first metal has a greater longitudinal size than a longitudinal size of the second metal area formed of the second metal.

In one embodiment of the invention, the first metal includes stainless steel, and the second metal includes nickel steel.

A cathode ray tube according to the present invention includes an electron gun for emitting at least one electron beam; a mask frame include a mask having a plurality of holes or slits for allowing the at least one electron beam to be transmitted therethrough and a frame to which the mask is attached; and a panel including a phosphor layer to be scanned by the at least one electron beam transmitted through the plurality of holes or slits of the mask. The panel includes a plurality of stud pins for supporting the frame. The frame includes a plurality of elastic supports engaged with the plurality of stud pins. At least one of the plurality of elastic supports includes an engagement portion having an engaging hole which is engaged with one of the plurality of stud pins. The engagement portion includes a plurality of sliding pieces forming a funnel shape provided in the engaging hole. Mask frame vibration causes a surface of each of the plurality of sliding pieces to rub against a respective stud pin so as to generate a frictional force for attenuating the vibration of the mask frame. The above-described objective can be achieved by this structure.

In one embodiment of the invention, the at least one elastic support includes a fixing portion for fixing the at least one elastic support to the frame, and a connection portion for connecting the fixing portion and the engagement portion.

In one embodiment of the invention, the sliding piece has a length of about 0.5 mm or more and about 2.5 mm or less.

In one embodiment of the invention, each of the plurality of elastic supports has a substantially strip-like shape.

In one embodiment of the invention, the mask includes a damper provided at an end thereof for attenuating the vibration of the mask.

In one embodiment of the invention, the electron gun includes an electric field electron emission element for reducing a cross-section of the at least one electron beam.

A cathode ray tube according to the present invention includes an electron gun for emitting at least one electron beam; a mask frame include a mask having a plurality of holes or slits for allowing the at least one electron beam to be transmitted therethrough and a frame to which the mask is attached; and a panel including a phosphor layer to be scanned by the at least one electron beam transmitted through the plurality of holes or slits of the mask. The panel includes a plurality of stud pins for supporting the frame. The frame includes a plurality of elastic supports engaged with the plurality of stud pins. At least one of the plurality of elastic supports includes an engagement portion having an engaging hole which is engaged with one of the plurality of stud pins. The engagement portion includes a central portion having the engaging hole, a first side portion separated from the central portion by a first cut, and a second side portion separated from the central portion by a second cut formed on an opposite side to the first cut with respect to the central portion. Mask frame vibration causes a cut sectional face of the central portion facing the first cut to rub against a cut sectional face of the first side portion so as to generate a frictional force for attenuating the vibration of the mask frame. Mask frame vibration further causes another cut sectional face of the central portion facing the second cut to rub against a cut sectional face of the second side portion so as to generate a frictional force for attenuating the vibration of the mask frame. The above-described objective can be achieved by this structure.

In one embodiment of the invention, the at least one elastic support includes a fixing portion for fixing the at least one elastic support to the frame, and a connection portion for connecting the fixing portion and the engagement portion to each other.

In one embodiment of the invention, each of the plurality of elastic supports has a substantially V-shaped cross-section.

In one embodiment of the invention, the mask includes a damper provided at an end thereof for attenuating the vibration of the mask.

In one embodiment of the invention, the electron gun includes an electric field electron emission element for reducing a cross-section of the at least one electron beam.

A cathode ray tube according to the present invention includes an electron gun for emitting at least one electron beam; a mask frame include a mask having a plurality of holes or slits for allowing the at least one electron beam to be transmitted therethrough and a frame to which the mask is attached; and a panel including a phosphor layer to be scanned by the at least one electron beam transmitted through the plurality of holes or slits of the mask. The panel includes a plurality of stud pins for supporting the frame. The frame includes a plurality of elastic supports engaged with the plurality of stud pins. At least one of the plurality of elastic supports includes an engagement portion having an engaging hole which is engaged with one of the plurality of stud pins and a fixing portion for fixing the at least one elastic support to the frame. The fixing portion includes a first bent portion and a second bent portion bent towards the engagement portion. The engagement portion includes a third bent portion bent so as to be in contact with the first bent portion and a fourth bent portion bent so as to be in contact with the second first bent portion. Mask frame vibration causes the first bent portion to rub against the third bent portion so as to generate a frictional force for attenuating the vibration of the mask frame. The mask frame vibration further causes the second bent portion to rub against the fourth bent portion so as to generate a frictional force for attenuating the vibration of the mask frame so as to generate a frictional force for attenuating the vibration of the mask frame. The above-described objective can be achieved by this structure.

In one embodiment of the invention, the at least one elastic support further includes a connection portion for connecting the fixing portion and the engagement portion to each other.

In one embodiment of the invention, each of the plurality of elastic supports has a substantially V-shaped cross-section.

In one embodiment of the invention, the first bent portion has a fifth bent portion for restricting the engagement portion from moving in a direction away from the fixing portion, and the second bent portion has a sixth bent portion for restricting the engagement portion from moving towards the fixing portion.

In one embodiment of the invention, the frame includes a plurality of corners, and the plurality of elastic supports are provided at respective corners.

In one embodiment of the invention, the frame includes a pair of first shafts and a pair of second shafts shorter than the pair of first shafts, and the at least one elastic support is provided on at least one first shaft of the pair of first shafts.

In one embodiment of the invention, the frame includes a pair of first shafts and a pair of second shafts shorter than the pair of first shafts, and the at least one elastic support is provided on at least one second shaft of the pair of second shafts.

In one embodiment of the invention, the mask includes a damper provided at an end thereof for attenuating the vibration of the mask.

In one embodiment of the invention, the electron gun includes an electric field electron emission element for reducing a cross-section of the at least one electron beam.

A cathode ray tube according to the present invention includes an electron gun for emitting at least one electron beam; a mask frame include a mask having a plurality of holes or slits for allowing the at least one electron beam to be transmitted therethrough and a frame to which the mask is attached; and a panel including a phosphor layer to be scanned by the at least one electron beam transmitted through the plurality of holes or slits of the mask. The panel includes a plurality of stud pins for supporting the frame. The frame includes a plurality of elastic supports engaged with the plurality of stud pins. At least one of the plurality of elastic supports includes an engagement portion having an engaging hole which is engaged with one of the plurality of the stud pins, a fixing portion for fixing the at least one elastic support to the frame, and a connection portion for connecting the fixing portion and the engagement portion to each other. An area of the fixing portion S1, an area of the connection portion S2, and an area of the engagement portion S3 satisfy the relationships of $S1 \geqq S2$ and $S1 \geqq S3$. The above-described objective can be achieved by this structure.

In one embodiment of the invention, the fixing portion has a first surface which is in contact with the frame and has a rough portion. The frame has a second surface which is in contact with the fixing portion and has a rough portion. The first surface and the second surface are fixed to each other by welding.

In one embodiment of the invention, the frame includes an attachment plate for fixing the fixing portion.

In one embodiment of the invention, the fixing portion has a first surface which is in contact with the attachment plate and has a rough portion. The attachment plate has a second surface which is in contact with the fixing portion and has a rough portion. The first surface and the second surface are fixed to each other by welding.

In one embodiment of the invention, the fixing portion includes a welding area fixed to the frame by welding, and the welding area is provided on an opposite side to the connection portion with respect to a central border of the fixing portion.

In one embodiment of the invention, an area of the fixing portion S1, an area of the connection portion S2 and an area of the engagement portion S3 satisfy the relationship of $S1 \geqq S2 \geqq S3$.

In one embodiment of the invention, the fixing portion includes a bent portion bent towards the frame.

In one embodiment of the invention, each of the plurality of elastic supports has a substantially V-shaped cross-section.

In one embodiment of the invention, each of the plurality of elastic supports has a substantially strip-like shape.

In one embodiment of the invention, a ratio of a total area of the at least one elastic support and a weight of the frame is about 5 $cm^2/kg$ or more.

In one embodiment of the invention, the frame includes a pair of first shafts and a pair of second shafts shorter than the pair of first shafts, and the at least one elastic support is provided on at least one first shaft of the pair of first shafts.

In one embodiment of the invention, the frame includes a pair of first shafts and a pair of second shafts shorter than the pair of first shafts, and the at least one elastic support is provided on at least one second shaft of the pair of second shafts.

In one embodiment of the invention, the frame includes a plurality of corners, and the plurality of elastic supports are provided at respective corners.

In one embodiment of the invention, the at least one elastic support has a bimetal structure including a first metal area formed of a first metal having a first coefficient of thermal expansion and a second metal area formed of a second metal having a second coefficient of thermal expansion which is less than the first coefficient of thermal expansion, the first metal area and the second metal being joined together.

In one embodiment of the invention, the first metal area formed of, the first metal has a greater longitudinal size than a longitudinal size of the second metal area formed of the second metal.

In one embodiment of the invention, the mask includes a damper provided at an end thereof for attenuating vibration of the mask.

In one embodiment of the invention, the electron gun includes an electric field electron emission element for reducing a cross-section of the at least one electron beam.

A cathode ray tube according to the present invention includes an electron gun for emitting at least one electron beam; a mask frame include a mask having a plurality of holes or slits for allowing the at least one electron beam to be transmitted therethrough and a frame to which the mask is attached; and a panel including a phosphor layer to be scanned by the at least one electron beam transmitted through the plurality of holes or slits of the mask. The panel includes a first stud pin and a second stud pin for supporting the frame. The frame includes a first elastic support and a second elastic support respectively engaged with the first stud pin and the second stud pin. The first stud pin pressurizes the first elastic support with a first pressure, and the second stud pin pressurizes the second elastic support with a second pressure which is substantially different from the first pressure. The above-described objective can be achieved by this structure.

In one embodiment of the invention, the first pressure and the second pressure are each about 5 N or more and about 100 N or less.

In one embodiment of the invention, the first elastic support and the second elastic support each have a spring coefficient of about 1 N/mm or more and about 25 N/mm or less.

In one embodiment of the invention, the frame includes a pair of first shafts and a pair of second shafts shorter than the pair of first shafts, and the at least one elastic support is provided on at least one first shaft of the pair of first shafts.

In one embodiment of the invention, the frame includes a pair of first shafts and a pair of second shafts shorter than the pair of first shafts, and the at least one elastic support is provided on at least one second shaft of the pair of second shafts.

In one embodiment of the invention, the frame includes a plurality of corners, and the plurality of elastic supports are provided at respective corners.

In one embodiment of the invention, the at least one elastic support has a bimetal structure including a first metal area formed of a first metal having a first coefficient of thermal expansion and a second metal area formed of a second metal having a second coefficient of thermal expansion which is less than the first coefficient of thermal expansion, the first metal area and the second metal being joined together.

In one embodiment of the invention, the first metal area formed of the first metal has a greater longitudinal size than a longitudinal size of the second metal area formed of the second metal.

In one embodiment of the invention, each of the plurality of elastic supports has a substantially V-shaped cross-section.

In one embodiment of the invention, each of the plurality of elastic supports has a substantially strip-like shape.

In one embodiment of the invention, the mask includes a damper provided at an end thereof for attenuating the vibration of the mask.

In one embodiment of the invention, the electron gun includes an electric field electron emission element for reducing a cross-section of the at least one electron beam.

A cathode ray tube according to the present invention includes an electron gun for emitting at least one electron beam; a mask frame include a mask having a plurality of holes or slits for allowing the at least one electron beam to be transmitted therethrough and a frame to which the mask is attached; and a panel including a phosphor layer to be scanned by the at least one electron beam transmitted through the plurality of holes or slits of the mask. The panel includes a plurality of stud pins for supporting the frame. The frame includes a plurality of elastic supports engaged with the plurality of stud pins. At least one of the plurality of elastic supports includes an engagement portion having an engaging hole which is engaged with one of the plurality of stud pins and an elastic portion in contact with the engagement portion. Mask frame vibration causes the elastic portion to rub against the engagement portion so as to generate a frictional force for attenuating the vibration of the mask frame so as to generate a frictional force for attenuating the vibration of the mask frame. The above-described objective can be achieved by this structure.

In one embodiment of the invention, the elastic portion is provided on each of both sides of the engaging hole.

In one embodiment of the invention, the elastic portion is a metal plate rolled into a cylindrical shape.

In one embodiment of the invention, the elastic portion is formed of a metal plate bent into a leaf spring-shape.

In one embodiment of the invention, the at least one elastic support includes a fixing portion for fixing the at least one elastic support to the frame, and the elastic portion is fixed to the fixing portion.

In one embodiment of the invention, each of the plurality of elastic supports has a substantially V-shaped cross-section.

In one embodiment of the invention, the mask includes a damper provided at an end thereof for attenuating the vibration of the mask.

In one embodiment of the invention, the electron gun includes an electric field electron emission element for reducing a cross-section of the at least one electron beam.

An image display apparatus according to the present invention includes each of the above-described cathode ray tubes. The above-described objective can be achieved by this structure.

According to one aspect of the invention, a cathode ray tube for substantially eliminating mislanding of electron beams can be provided since even when the frame vibrates, friction is generated between an elastic portion of an elastic support and a stud pin on the frame, which rapidly attenuates the vibration of the frame.

According to another aspect of the invention, a cathode ray tube for substantially eliminating mislanding of electron beams can be provided since even when the frame vibrates, friction is generated between a plurality of sliding pieces forming a funnel shape of an elastic support and a stud pin on the frame, which rapidly attenuates the vibration of the frame.

According to still another aspect of the invention, a cathode ray tube for substantially eliminating mislanding of electron beams can be provided since even when the frame vibrates, a cut sectional face of a central portion of an elastic support and a cut sectional face of each of side portions of the elastic support rub against each other, which rapidly attenuates the vibration of the frame.

According to still another aspect of the invention, a cathode ray tube for substantially eliminating mislanding of electron beams can be provided since even when the frame vibrates, bent portions of an elastic support rub against each other, which rapidly attenuates the vibration of the frame.

According to still another aspect of the invention, a cathode ray tube for substantially eliminating mislanding of electron beams can be provided since even when the frame vibrates, a fixing portion of an elastic support having the largest area rubs against the frame, which rapidly attenuates the vibration of the frame.

According to still another aspect of the invention, a cathode ray tube for substantially eliminating mislanding of electron beams can be provided since even when a strong impact such as an impact applied by a package dropping test is applied, a fixing portion of an elastic support and the frame which are welded together are prevented from being detached from each other, which rapidly attenuates the vibration of the frame.

According to still another aspect of the invention, the distance between a welded area of the fixing portion and the engagement portion of an elastic support is extended, which can effectively restrict mislanding of the electron beams caused by a temperature rise while the cathode ray tube is in operation. A non-welded area of the fixing portion which is between the welded area and the connection portion can be enlarged. When the frame vibrates, friction is generated between the non-welded area and the fixing portion. Therefore, the vibration of the frame can be rapidly attenuated.

According to still another aspect of the invention, the internal stress of a plurality of elastic supports can be different. Therefore, even the elastic supports having the same shape can be different in natural frequency and thus in resonance frequency. Thus, the vibration of the frame can be rapidly attenuated.

According to still another aspect of the invention, vibration energy of the mask of the cathode ray tube can be converted into friction energy by a damper, which rapidly attenuates the vibration of the frame.

BEST MODE FOR CARRYING OUT THE INVENTION

Hereinafter, the present invention will be described by way of examples with reference to drawings.

EXAMPLE 1

Figure 1A:
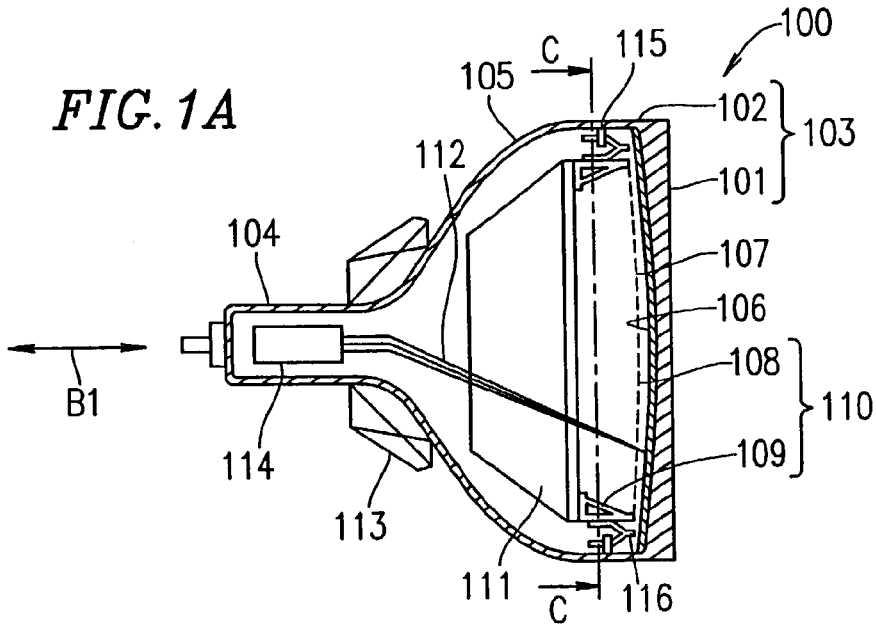
FIG. 1A is a schematic view of a cathode ray tube in Example 1 according to the present invention.
Figure 1B:
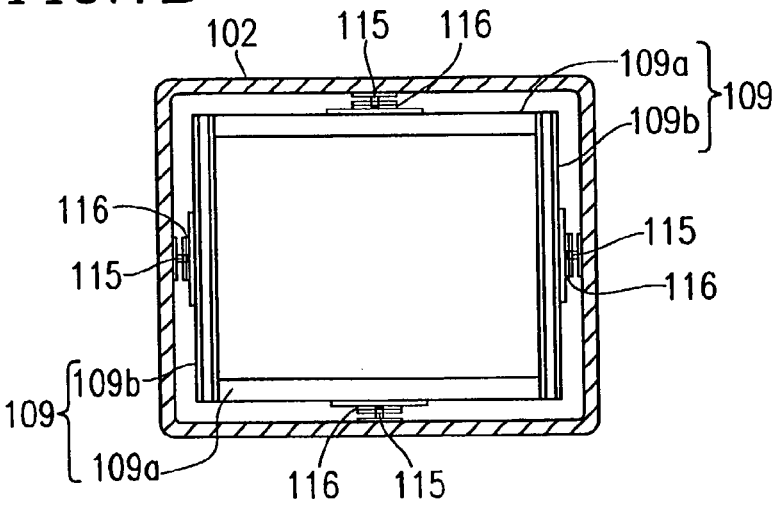
FIG. 1B shows a mask frame supporting device shown in FIG. 1A.

FIG. 1A shows a cathode ray tube 100 in Example 1 according to the present invention. FIG. 1B is a cross-sectional view of the cathode ray tube 100 shown in FIG. 1A taken along lines C—C in FIG. 1A. The cathode ray tube 100 includes a substantially quadrangular panel 103 having an effective display section 101 and a side wall 102 provided around four sides thereof, and a funnel 105 including a neck 104.

On an inner surface of the effective display section 101 of the panel 103, a phosphor screen 106 is provided. The phosphor screen 106 includes three color phosphor elements respectively providing red (R), green (G) and blue (B) light, which are arranged two-dimensionally. A mask frame 110 is engaged with the panel 103 so as to face the phosphor screen 106 by a mask frame supporting device described later. The mask frame 110 includes a frame 109 and a substantially quadrangular mask 108 attached to the frame 109. The mask 108 has a gradual curved surface, which has a plurality of electron beam transmission holes (or slits) 107.

Figure 1C:
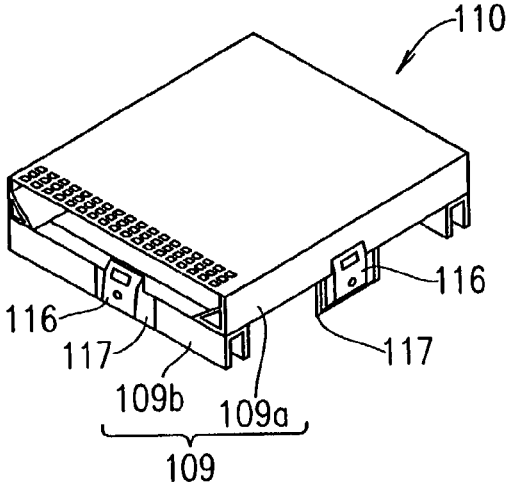
FIG. 1C shows a structure of the mask frame shown in FIG. 1A.

FIG. 1C is an isometric view of the mask frame 110. As shown in FIG. 1C, the frame 109 of the mask frame 110 includes two first shafts 109*a* and two second shafts 109*b*. The first shafts 109*a* are longer than the second shafts 109*b*. The first shafts 109*a* each have a triangular (or L-shaped) cross-section and are formed of an Fe-Ni alloy. The two second shafts 109*b* each have a generally U-shaped (or L-shaped, quadrangular or polygonal) cross-section and are formed of an Fe-Ni alloy. The mask 108 is welded to and extended between the two first shafts 109*a*. Generally, the mask 108 is formed of the same material as that of the frame 109. When a type of the Fe-Ni alloy which contains 36 wt. % of Ni (commercially referred to as "Invar") is used, the coefficient of thermal expansion can be reduced and thus the thermal deformation in operation can be minimized. The frame 109 is provided with an inner magnetic shield 111 (FIG. 1A) for shielding an external magnetic field such as geomagnetism.

The neck 104 of the funnel 105 accommodates an electron gun 114 for emitting three electron beams 112, and a deflection yoke 113 is provided on an outer surface of the funnel 105. A color image is displayed by deflecting the three electron beams 112 by a magnetic field generated by the deflection yoke 113 and horizontally and vertically scanning the phosphor screen 106 with the three electron beams 112 through the mask 108.

The mask frame supporting device for engaging the mask frame 110 with the panel 103 will be described with reference to FIG. 1B. The mask frame supporting device includes stud pins 115 respectively attached to four inner faces of the side wall 102 of the panel 103, and elastic supports 116 respectively fixed to the two first shafts 109*a* and the two second shafts 109*b* of the frame 109. Each stud pin 115 is attached to a substantially central position of the respective inner face of the side wall 102, and each elastic support 116 is fixed to a substantially central position of the respective shaft 109*a* or 109*b*. The elastic supports 116 are formed of stainless steel or an MN-15M alloy. The elastic supports 116 and the stud pins 115 are respectively detachably engaged with each other.

Referring to FIG. 1C, each elastic support 116 is fixed to the respective shaft 109*a* or 109*b* by, for example, welding through an attachment plate 117 at a position where the elastic support 116 can be accurately engaged with a respective stud pin 115. Each attachment plate 117 is directly fixed to the respective shaft 109*a* or 109*b* by welding.

Figure 2A:
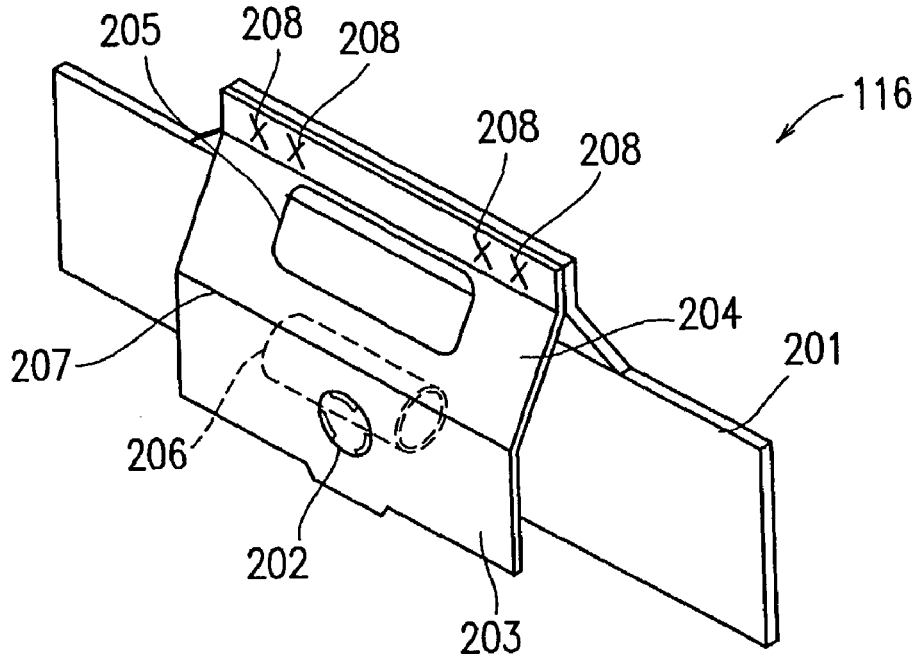
FIG. 2A is a schematic view of an elastic support in the cathode ray tube in Example 1.
Figure 2B:
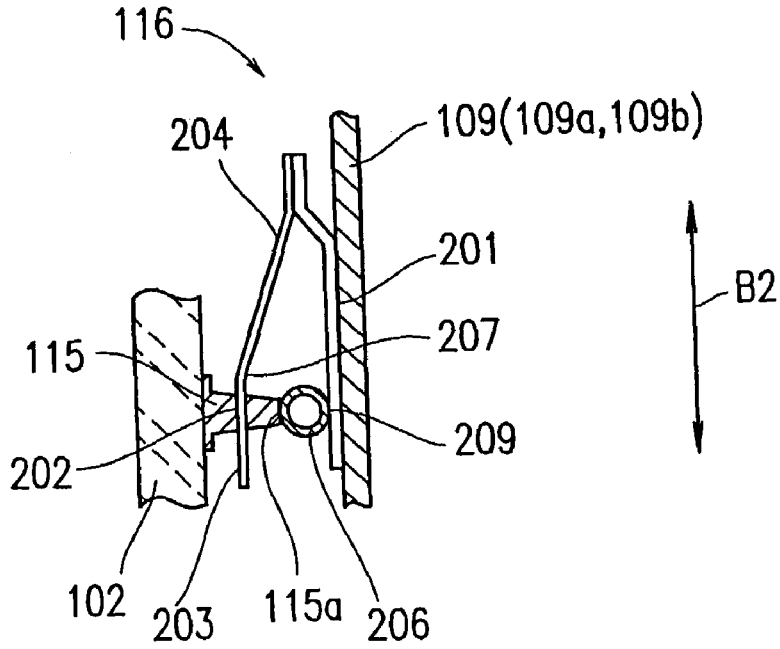
FIG. 2B is a side view of the elastic support in the cathode ray tube in Example 1.

FIG. 2A is an isometric view of the elastic support 116, and FIG. 2B is a side view of the elastic support 116. The description below will be done regarding one elastic support 116 for convenience unless specified otherwise.

As shown in FIGS. 2A and 2B, the elastic support 116 includes a fixing portion 201 to be fixed to the substantially central position of the respective shaft 109*a* or 109*b* by welding or the like, an engagement portion 203 including a flat surface having an engaging hole 202 through which the stud pin 115 is inserted, and a connection portion 204 which is inclined with respect to the fixing portion 201 and the engagement portion 203 for connecting the fixing portion 201 and the engagement portion 203 together. The connection portion 204 and the engagement portion 203 are bent with respect to each other along a bending edge 207. The connection portion 204 is shown as being flat in FIGS. 2A and 2B, but can be curved. The connection portion 204 can be curved by a plurality of bending edges which are parallel to the bending edge 207. The connection portion 204 can have a hole 205 for reducing a spring coefficient of the engagement portion 203 so as to facilitate the detachment of the mask frame 109 from the panel 103. The engagement portion 203 and the connection portion 204 are integrally formed by bending processing, and the connection portion 204 and the fixing portion 201 are joined to each other by welding respective ends thereof. Welding points 208 are indicated with an "X".

The elastic support 116 further includes an elastic portion 206 formed of a metal plate rolled into a cylindrical shape. The elastic portion 206 is fixed to the fixing portion 201 at a point 209 by welding or the like. When the stud pin 115 is inserted through the engaging hole 202, a tip 115*a* of the stud pin 115 is constantly in contact with the elastic portion 206. Accordingly, when the mask frame 110 vibrates in axial directions of the cathode ray tube 100 (in directions indicated by the two-headed arrow B1 in FIG. 1A, i.e., in directions indicated by the two-headed arrow B2 in FIG. 2B), the tip 115*a* of the stud pin 115 rubs against the elastic portion 206. At this point, vibration energy is converted into friction energy, and thus the vibration of the mask frame 110 is rapidly attenuated.

When the mask frame 110 vibrates in planar directions (directions perpendicular to the directions indicated by the two-headed arrow B1 in FIG. 1A), the frame 109 pushes and pulls the elastic support 116. Therefore, the elastic support 116 moves the frame 109 in the axial directions. As a result, an effect similar to the above-described effect is obtained.

The cathode ray tube 100 having the above-described structure was incorporated into a commercially available TV. While each of single-color images of R, G and B was displayed, the frequency of an attached speaker was swept from 70 Hz to 15000 Hz at an output of 10 W. No degradation of color purity was observed.

For comparison, a comparative cathode ray tube (not shown; referred to as "cathode ray tube (1)" for convenience) having the same structure as that of the cathode ray tube 100 except that the elastic supports do not have elastic portions was incorporated into a commercially available TV and vibration of the above-described speaker was applied to the comparative cathode ray tube (1). A degradation of color purity was observed in the image due to vibration of a frequency of even 80 Hz to 130 Hz. Even after the vibration of the speaker was stopped, the degradation of color purity caused by the vibration of the mask frame was still observed for several seconds or longer.

Based on these results, it is considered that the cathode ray tube 100 having the structure in Example 1 did not cause degradation of color purity for the following reason. When the mask frame 110 was vibrated due to the vibration of the speaker, the elastic portion 206 of each elastic support 116 rubbed against the tip 115*a* of a respective stud pin 115, and the friction between the elastic portion 206 and the tip 115*a* rapidly attenuated the vibration, thus preventing degradation of color purity.

In the above example, all four of the elastic supports 116 have the structure shown in FIGS. 2A and 2B. A similar effect is provided when at least one of the four elastic supports is the elastic support 116 shown in FIGS. 2A and 2B while the other elastic supports do not have any elastic portion 206.

The fixing portion 201 has a thickness of about 0.3 mm or more, preferably about 1 mm or more, and in consideration of weight and cost, about 3 mm or less. The connection portion 204 and the engagement portion 203 each have a thickness of about 0.3 mm or more and preferably less than the thickness of the fixing portion 201. The thickness of each of the connection portion 204 and the engagement portion 203 is preferably about 1 mm or less in order to have an appropriate level of elasticity so that the mask frame 110 can be relatively easily detached from the panel 103 during the production process. The elastic portion 206 preferably has a thickness of equal to or less than the thickness of the connection portion 204 and the engagement portion 203, and more preferably about 0.05 mm or more and about 0.3 mm or less. The elastic portion 206 may be opened or closed at each of two ends of the cylindrical shape.

A thousand or more cathode ray tubes 100 in Example 1 were produced, and no trouble was experienced in detaching the mask frame 110 from the panel 103 during the process of forming the phosphor layer, such that the yield of the cathode ray tube 100 was 100%.

EXAMPLE 2

Figure 3A:
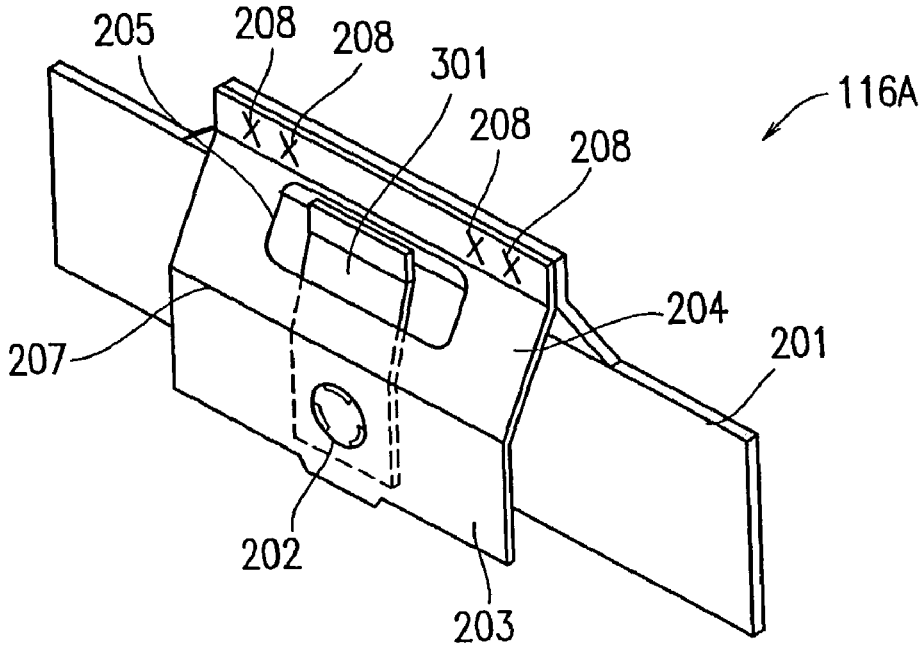
FIG. 3A is a schematic view of an elastic support in a cathode ray tube in Example 2.
Figure 3B:
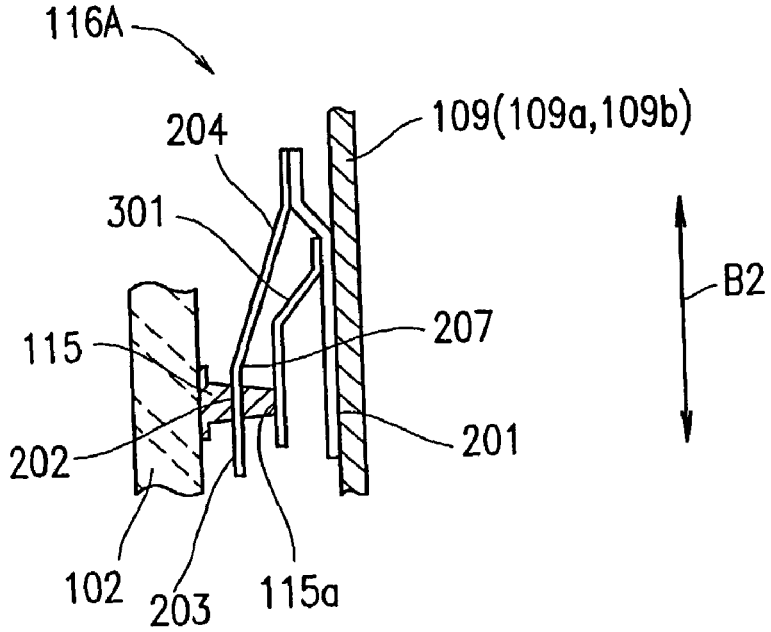
FIG. 3B is a side view of the elastic support in the cathode ray tube in Example 2.

In Example 2 according to the present invention, a cathode ray tube having the structure shown in FIGS. 1A through 1C includes elastic supports 116A shown in FIGS. 3A and 3B instead of the elastic supports 116 shown in FIGS. 2A and 2B. Identical elements previously discussed with respect to FIGS. 2A and 2B bear identical reference numerals and the descriptions thereof will be omitted. The description below will be done regarding one elastic support 116A for convenience unless specified otherwise.

The elastic support 116A includes an elastic portion 301 having a different structure from that of the elastic portion 206. The elastic portion 301 is a metal plate bent into a leaf spring shape. One of two ends of the elastic portion 301 is fixed to the fixing portion 201 by welding. As in the structure shown in FIGS. 2A and 2B, when the stud pin 115 is inserted through the engaging hole 202, the tip 115*a* of the stud pin 115 is constantly in contact with the elastic portion 301.

When the mask frame 110 (FIG. 1A) vibrates in directions indicated by the two-headed arrow B2 in FIG. 3B, the tip 115*a* of the stud pin 115 rubs against the elastic portion 301 to cause friction. Thus, the vibration of the mask frame 110 is rapidly attenuated.

The cathode ray tube including the elastic supports 116A was incorporated into a commercially available TV, and vibration of a speaker was applied as in Example 1. No degradation of color purity was observed. The thicknesses of the fixing portion 201, the connection portion 204, the engagement portion 203, and the elastic portion 301 are substantially the same as those in Example 1.

EXAMPLE 3

Figure 4A:
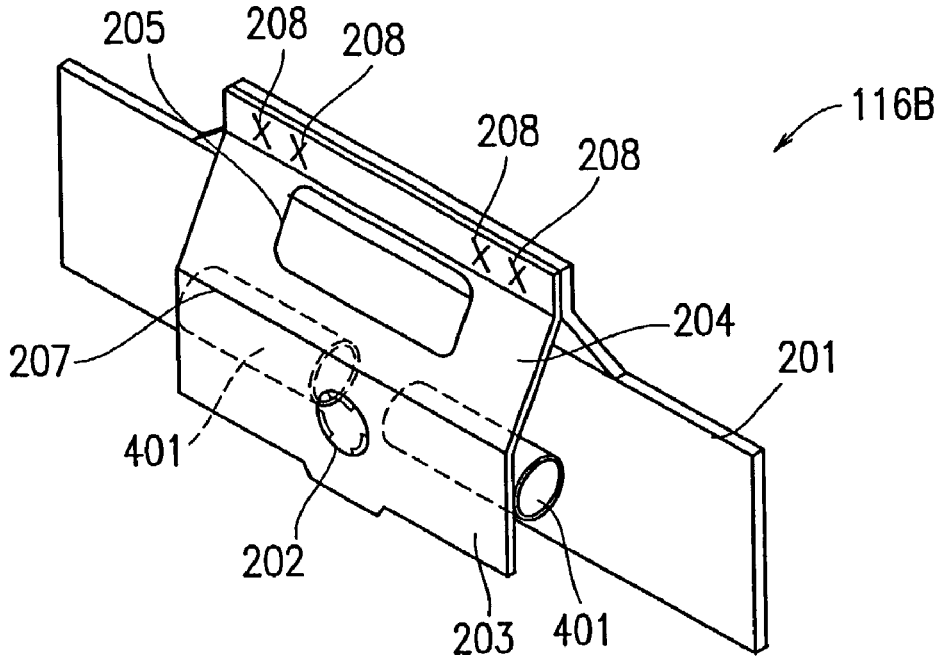
FIG. 4A is a schematic view of an elastic support in a cathode ray tube in Example 3.
Figure 4B:
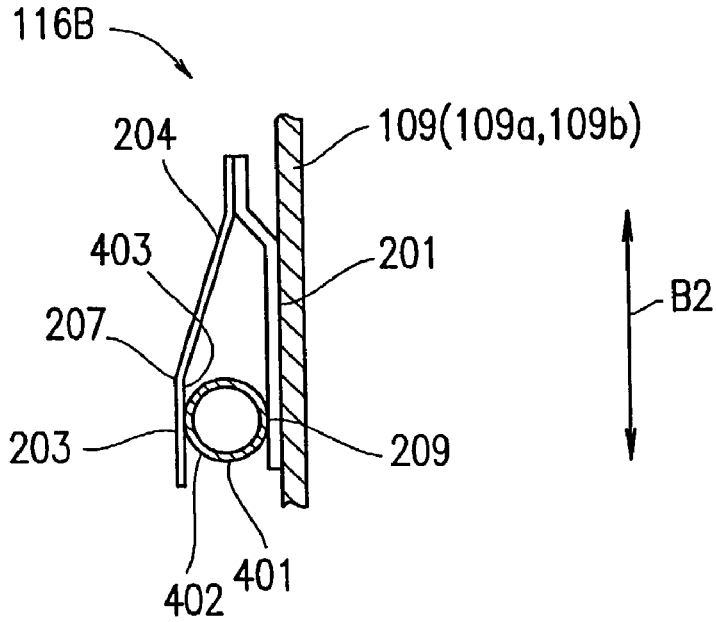
FIG. 4B is a side view of the elastic support in the cathode ray tube in Example 3.

In Example 3 according to the present invention, a cathode ray tube having the structure shown in FIGS. 1A through 1C includes elastic supports 116B shown in FIGS. 4A and 4B instead of the elastic supports 116 shown in FIGS. 2A and 2B. Identical elements previously discussed with respect to FIGS. 2A and 2B bear identical reference numerals and the descriptions thereof will be omitted. The description below will be done regarding one elastic support 116B for convenience unless specified otherwise.

The elastic support 116B includes an elastic portion 401 having a different structure from that of the elastic portion 206. The elastic portion 401 includes two metal plates each rolled into a cylindrical shape. The two metal plates in the cylindrical shape are fixed to the fixing portion 201 by welding so as to have the engaging hole 202 interposed. When the stud pin (not shown) is inserted through the engaging hole 202, an outer surface 402 of each elastic portion 401 and an inner surface 403 of the engagement portion 203 are constantly in contact with each other.

Accordingly, when the mask frame 110 (FIG. 1A) vibrates in directions indicated by the two-headed arrow B2 in FIG. 4B, the inner surface 403 of the engagement portion 203 rubs against the outer surface 402 in each elastic portion 401 to cause friction. Thus, the vibration of the mask frame 110 is rapidly attenuated.

When the mask frame 110 vibrates in planar directions (directions perpendicular to the directions indicated by the two-headed arrow B1), the vibration of the mask frame 110 is restricted as described in Example 1.

The cathode ray tube including the elastic supports 116B was incorporated into a commercially available TV, and vibration of a speaker was applied as in Example 1. No degradation of color purity was observed. The thicknesses of the fixing portion 201, the connection portion 204, the engagement portion 203, and the elastic portion 401 are substantially the same as those in Example 1.

A combined use of the elastic support 116B and the elastic portion 206 (Example 1) and/or 301 (Example 2) can enhance the attenuation effect of the vibration of the mask frame 110. The elastic portion 401 may be fixed to the connection portion 204 or the engagement portion 203 instead of being fixed to the fixing portion 201, such that a similar effect can be provided.

EXAMPLE 4

Figure 5A:
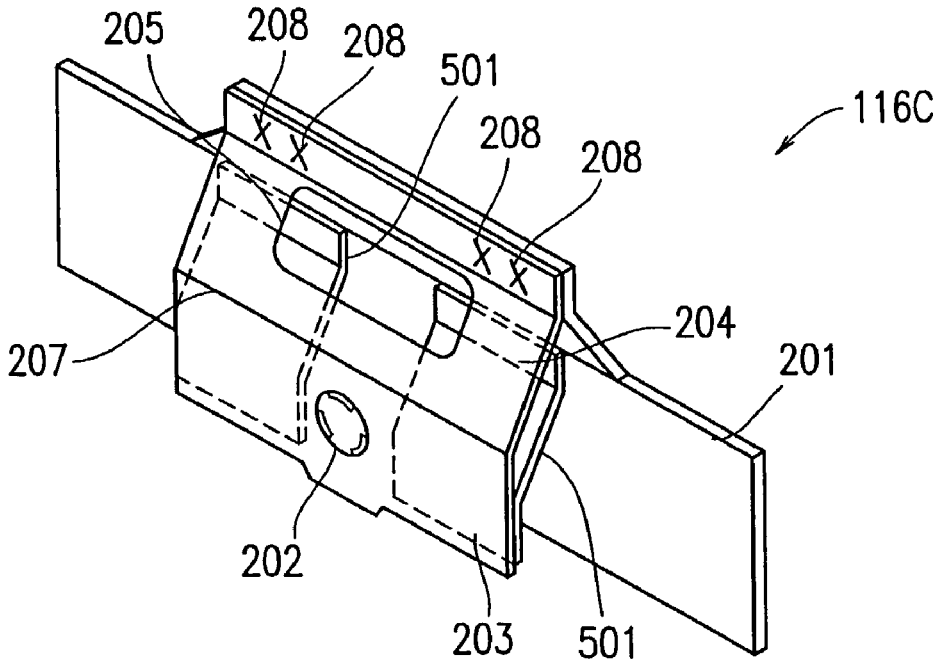
FIG. 5A is a schematic view of an elastic support in a cathode ray tube in Example 4.
Figure 5B:
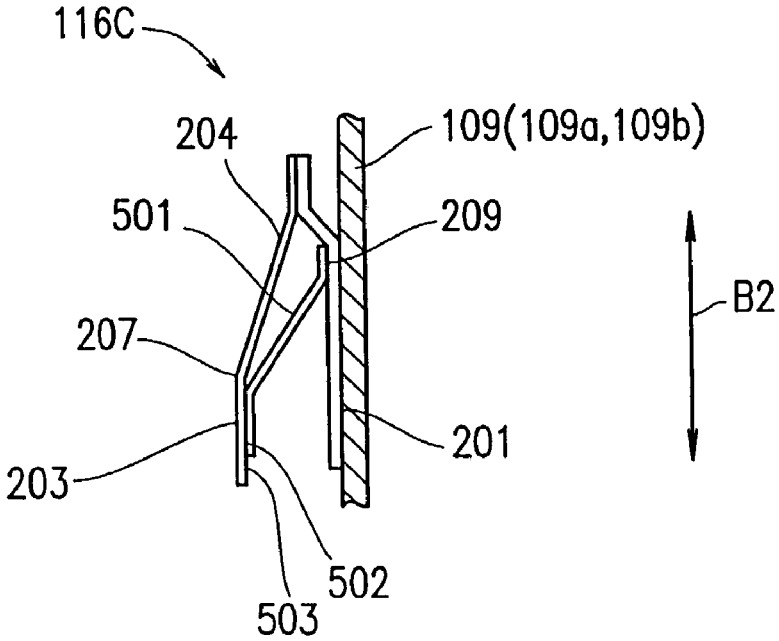
FIG. 5B is a side view of the elastic support in the cathode ray tube in Example 4.

In Example 4 according to the present invention, a cathode ray tube having the structure shown in FIGS. 1A through 1C includes elastic supports 116C shown in FIGS. 5A and 5B instead of the elastic supports 116 shown in FIGS. 2A and 2B. Identical elements previously discussed with respect to FIGS. 2A and 2B bear identical reference numerals and the descriptions thereof will be omitted. The description below will be done regarding one elastic support 116C for convenience unless specified otherwise.

The elastic support 116C includes an elastic portion 501 having a different structure from that of the elastic portion 206. The elastic portion 501 includes two metal plates each bent into a leaf spring shape. The two metal plates in the leaf spring shape are each fixed to the fixing portion 201 along an end thereof by welding so as to have the engaging hole 202 interposed. When the stud pin 115 (not shown) is inserted through the engaging hole 202, an outer surface 502 of each elastic portion 501 and an inner surface 503 of the engagement portion 203 are constantly in contact with each other.

Accordingly, when the mask frame 110 (FIG. 1A) vibrates in directions indicated by the two-headed arrow B2 in FIG. 5B and the directions perpendicular thereto, the inner surface 503 of the engagement portion 203 rubs against the outer surface 502 in each elastic portion 501 to cause friction. Thus, the vibration of the mask frame 110 is rapidly attenuated.

The cathode ray tube including the elastic supports 116C was incorporated into a commercially available TV, and vibration of a speaker was applied as in Example 1. No degradation of color purity was observed. The thicknesses of the fixing portion 201, the connection portion 204, the engagement portion 203, and the elastic portion 501 are substantially the same as those in Example 1.

A combined use of the elastic support 116C and the elastic portion 206 (Example 1) and/or 301 (Example 2) can enhance the attenuation effect of the vibration of the mask frame 110.

EXAMPLE 5

Figure 6:
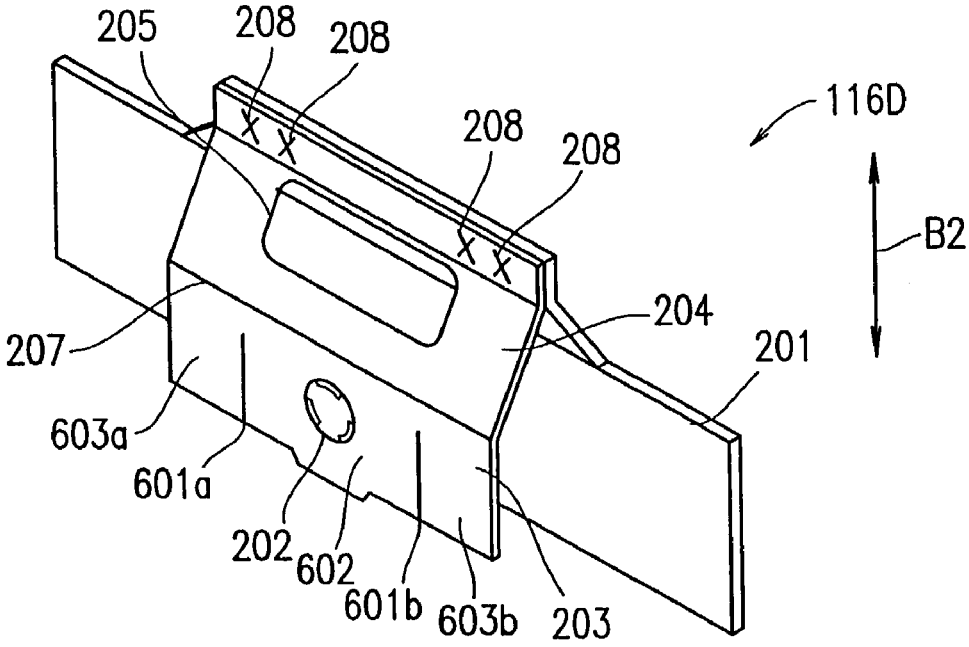
FIG. 6 is a schematic view of an elastic support in a cathode ray tube in Example 5.

In Example 5 according to the present invention, a cathode ray tube having the structure shown in FIGS. 1A through 1C includes elastic supports 116D shown in FIG. 6 instead of the elastic supports 116 shown in FIGS. 2A and 2B. Identical elements previously discussed with respect to FIGS. 2A and 2B bear identical reference numerals and the descriptions thereof will be omitted. The description below will be done regarding one elastic support 116D for convenience unless specified otherwise.

The elastic support 116D has two cuts 601*a* and 601*b* so as to have the engaging hole 202 interposed. That is, the engagement portion 203 is divided into a central portion 602 and two side portions 603*a* and 603*b* by the cuts 601*a* and 601*b*, respectively.

Accordingly, when the mask frame 110 (FIG. 1A) vibrates in directions indicated by the two-headed arrow B2 in FIG. 5B and directions perpendicular thereto, the central portion 602 and the side portions 603*a* and 603*b* move differently from each other. Thus, a cut sectional face of the central portion 602 facing the side portion 603*a* rubs against a cut sectional face of the side portion 603*a* so as to cause friction, and a cut sectional face of the central portion 602 facing the side portion 603*b* rubs against a cut sectional face of the side portion 603*b* so as to cause friction. As a result, the vibration of the mask frame 110 is rapidly attenuated.

The cathode ray tube including the elastic supports 116D was incorporated into a commercially available TV, and vibration of a speaker was applied as in Example 1. No degradation of color purity was observed. The thicknesses of the fixing portion 201, the connection portion 204, the engagement portion 203, and the elastic portion 601 are substantially the same as those in Example 1.

A combined use of the elastic supports 116D in Example 5 and the elastic portion 206 (Example 1) and/or 301 (Example 2) can enhance the attenuation effect of the vibration of the mask frame 110.

EXAMPLE 6

Figure 7A:
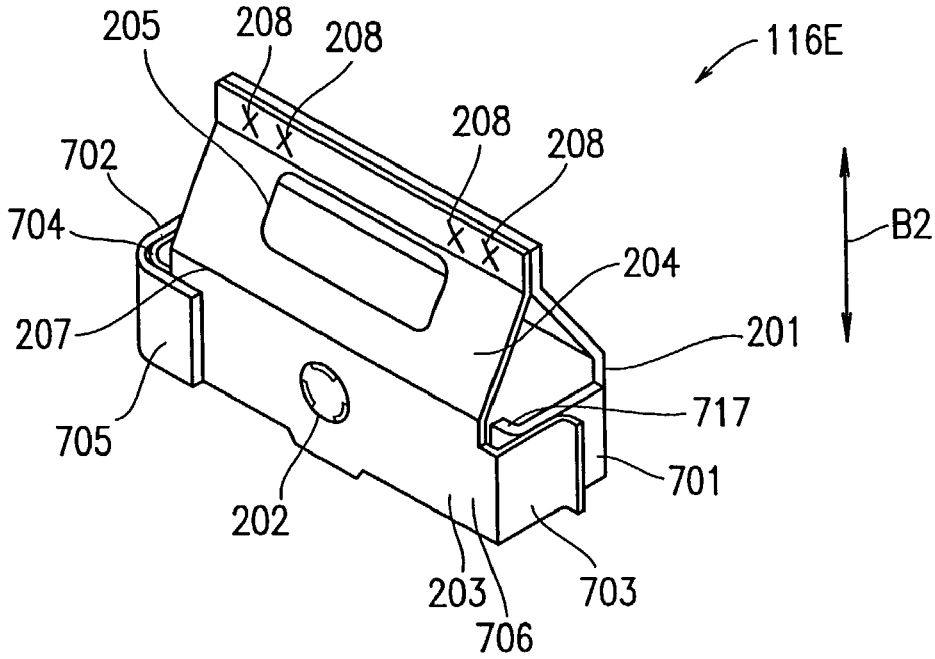
FIG. 7A is a schematic view of an elastic support in a cathode ray tube in Example 6.
Figure 7B:
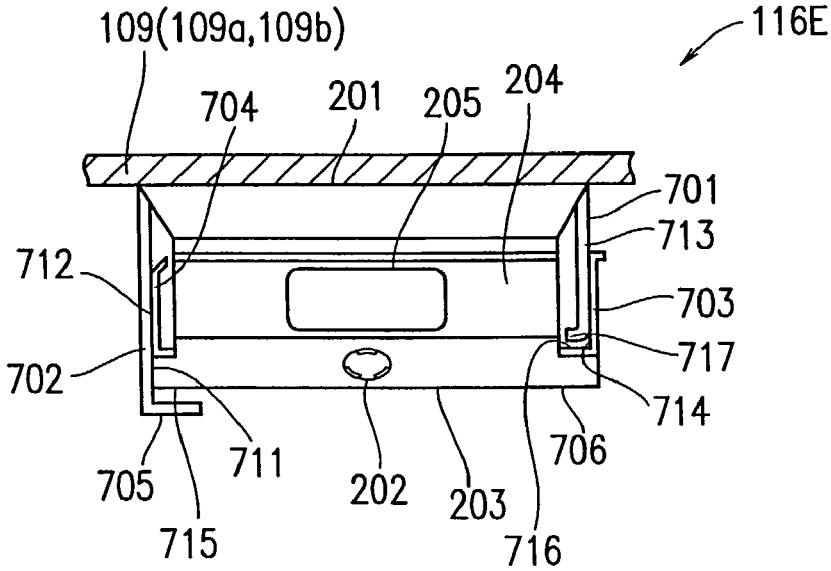
FIG. 7B is a side view of the elastic support in the cathode ray tube in Example 6.

In Example 6 according to the present invention, a cathode ray tube having the structure shown in FIGS. 1A through 1C includes elastic supports 116E shown in FIGS. 7A and 7B instead of the elastic supports 116 shown in FIGS. 2A and 2B. Identical elements previously discussed with respect to FIGS. 2A and 2B bear identical reference numerals and the descriptions thereof will be omitted. The description below will be done regarding one elastic support 116E for convenience unless specified otherwise.

In the elastic support 116E, the fixing portion 201 includes two bent portions 701 and 702 bent towards the engagement portions 203, and the engagement portion 203 includes two bent portions 703 and 704 bent towards the fixing portion 201. As best shown in FIG. 7B, the bent portion 702 covers the bent portion 704 so that an inner surface 711 of the bent portion 702 is in contact with an outer surface 712 of the bent portion 704. The bent portion 703 covers the bent portion 701 so that an inner surface 714 of the bent portion 703 is in contact with an outer surface 713 of the bent portion 701.

Accordingly, when the mask frame 110 (FIG. 1A) vibrates in directions in FIG. 7A indicated by the double-headed arrow B2 (i.e. directions perpendicular to the sheet of FIG. 7B) and directions parallel to the sheet of FIG. 7B, the inner surface 711 of the bent portion 702 rubs against the outer surface 712 of the bent portion 704 to cause friction, and the inner surface 714 of the bent portion 703 rubs against the outer surface 713 of the bent portion 701 to cause friction. As a result, the vibration of the mask frame 110 is rapidly attenuated.

The bent portion 702 includes a further bent portion 705 bent so as to partially cover an outer surface 715 of the engagement portion 203. The engagement portion 203 includes an extended portion 706 extending to the bent portion 703, and the bent portion 701 includes a further bent portion 717. Due to such a structure, the elastic support 116E has another function of preventing an excessive deformation of the elastic support 116E and thus preventing the electron beams from landing at unintended, shifted positions when a large external impact caused by a package dropping test, for example, is applied to the cathode ray tube. This function is provided by the following principle.

When the elastic support 116E receives an impact which moves the engagement portion 203 away from the fixing portion 201, the bent portion 705 touches the outer surface 715 of the engagement portion 203, restricting the engagement portion 203 from moving away from the fixing portion 201. When the elastic support 116E receives an impact which moves the engagement portion 203 towards the fixing portion 201, an inner surface 716 of the extended portion 706 touches the bent portion 717, restricting the engagement portion 203 from moving towards the fixing portion 201.

Figure 22A:
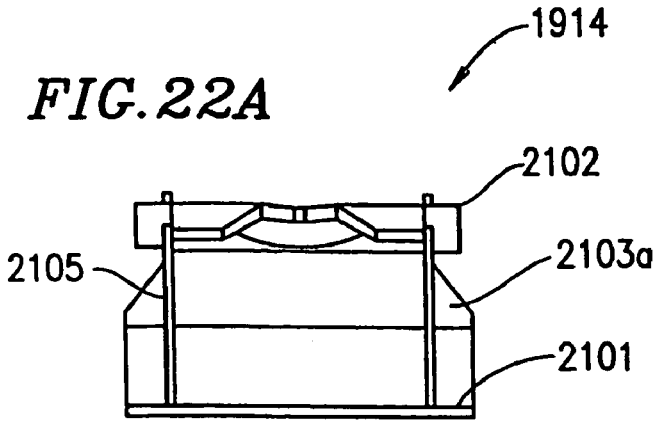
PRIOR ART FIG. 22A
FIG. 22A is a bottom view of a conventional elastic support shown in FIG. 22A.
Figure 22B:
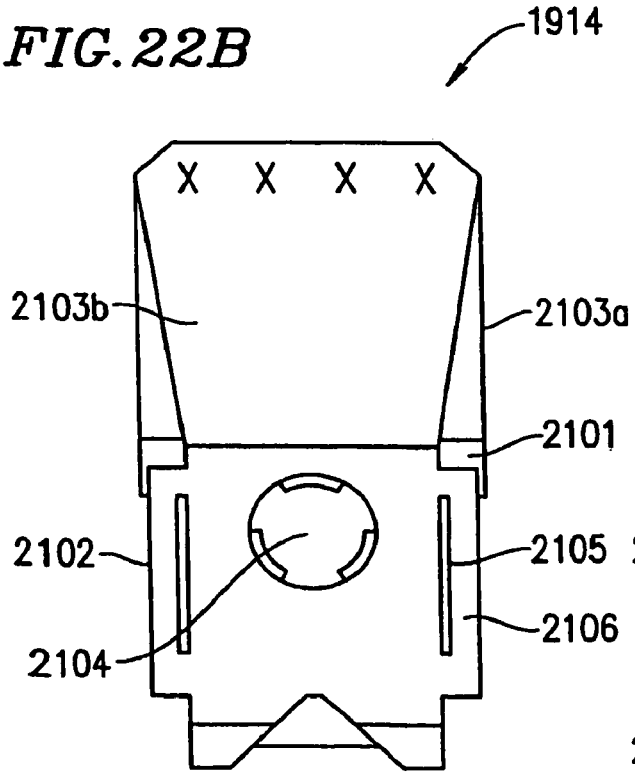
PRIOR ART FIG. 22B
FIG. 22B is a front view of the conventional elastic support shown in FIG. 22A.
Figure 22C:
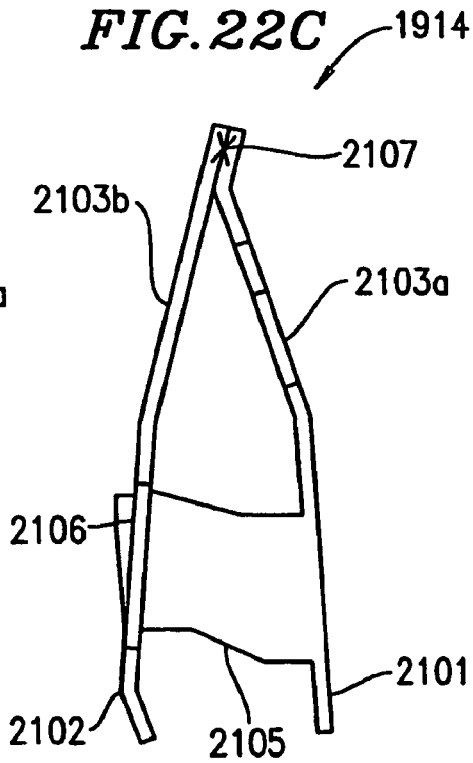
PRIOR ART FIG. 22C
FIG. 22C is a side view of the conventional elastic support shown in FIG. 22A.

The cathode ray tube including the elastic supports 116E was incorporated into a commercially available TV, and vibration of a speaker was applied as in Example 1. No degradation of color purity was observed. The TV was dropped from a prescribed height in various orientations. No degradation of color purity was observed. The test was repeated several times. Unlike the conventional elastic support 1914 shown in FIGS. 22A through 22C, the bent portions of the elastic supports 116E were never locked with each other to be unmovable.

The thicknesses of the fixing portion 201, the connection portion 204, and the engagement portion 203 are substantially the same as those in Example 1.

Figure 20A:
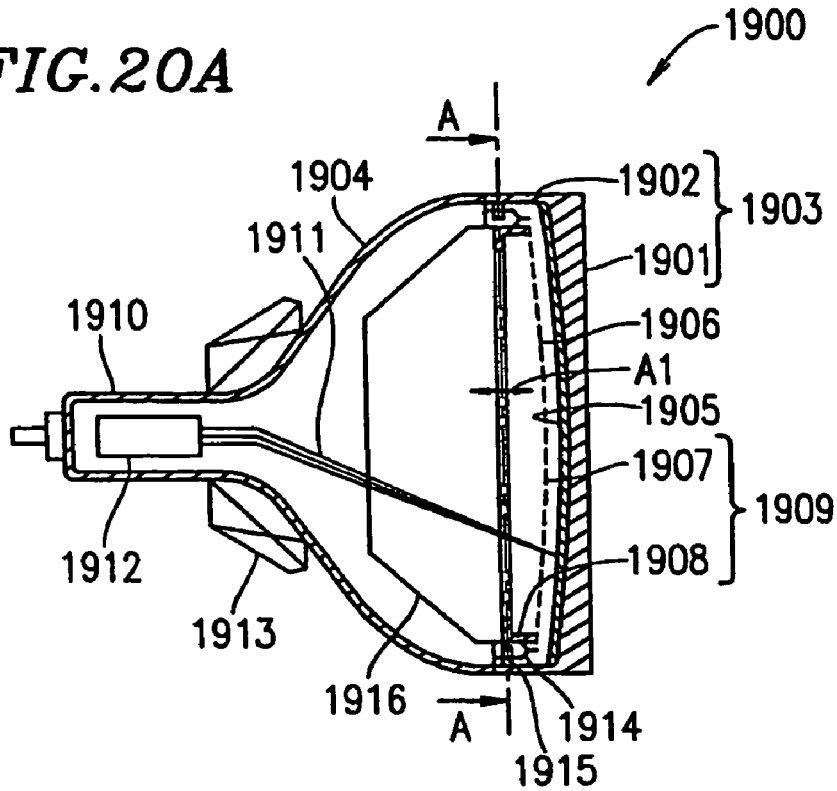
PRIOR ART FIG. 20A
FIG. 20A is a schematic view of a conventional cathode ray tube.
Figure 20B:
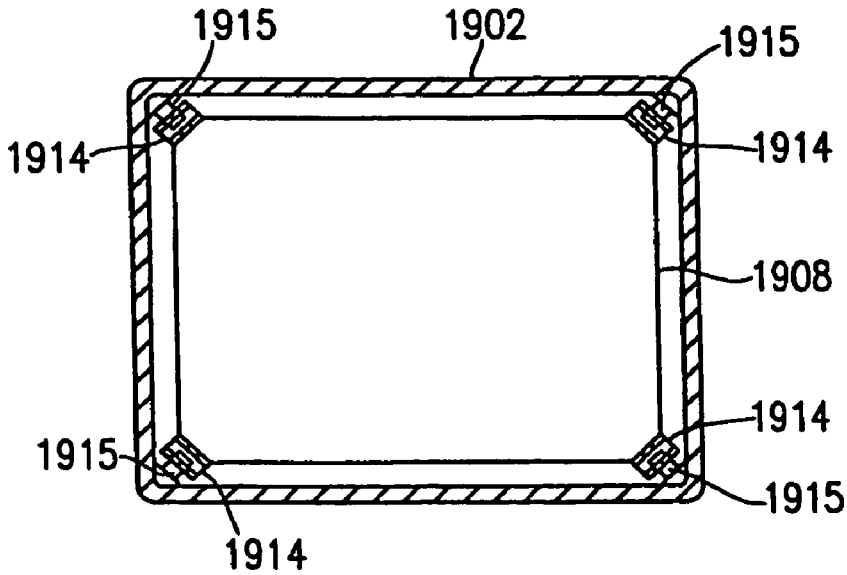
PRIOR ART FIG. 20B
FIG. 20B shows a mask frame supporting device shown in FIG. 20A.

The elastic supports 116, 116A, 116B, 116C, 116D and 116E may be provided at the four corners of the mask frame 110 as shown in FIG. 20B, such that a similar effect can be provided. In such a case, however, the fixing portion 201 needs to be reduced so as to fit a size of the corner areas which are relatively small.

EXAMPLE 7

Figure 8A:
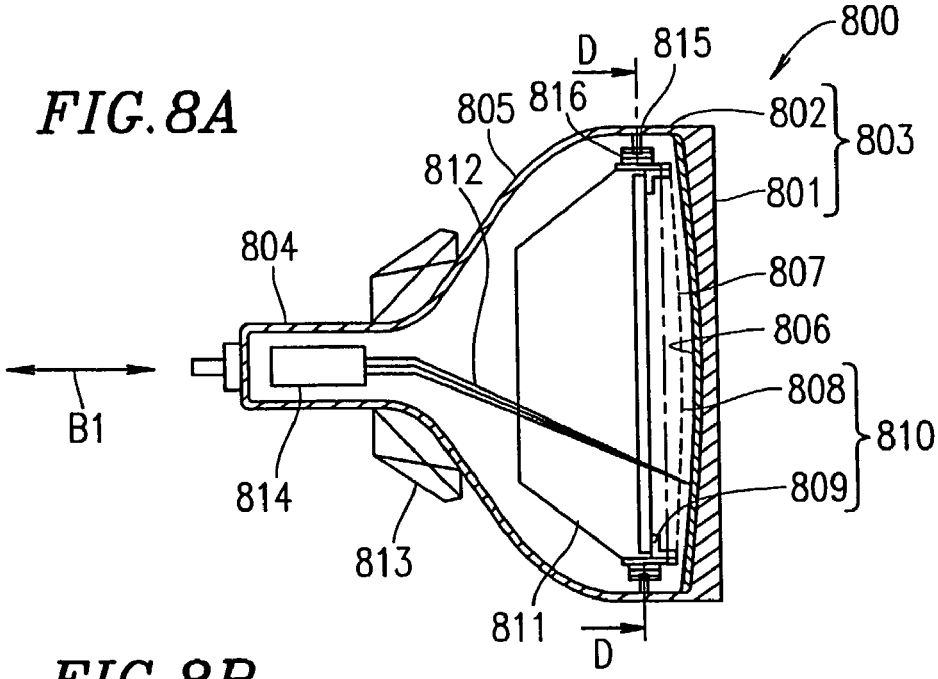
FIG. 8A is a schematic view of a cathode ray tube in Example 7 according to the present invention.
Figure 8B:
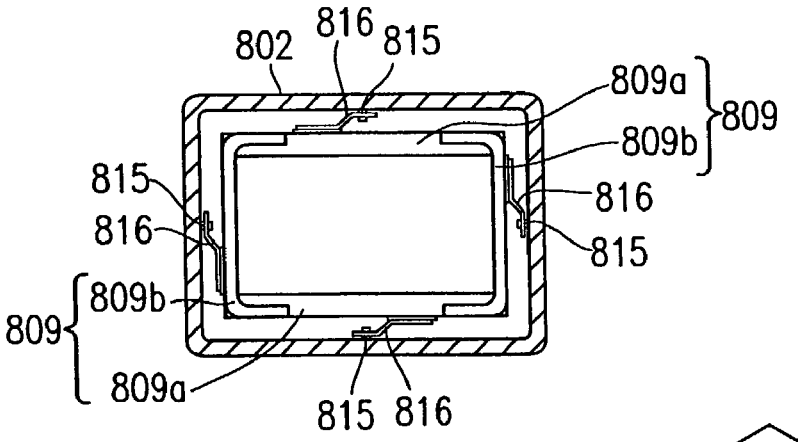
FIG. 8B shows a mask frame supporting device shown in FIG. 8A.

FIG. 8A shows a cathode ray tube 800 in Example 7 according to the present invention. FIG. 8B is a cross-sectional view of the cathode ray tube 800 shown in FIG. 8A taken along line D—D in FIG. 8A. The cathode ray tube 800 includes a substantially quadrangular panel 803 having an effective display section 801 and a side wall 802 provided around four sides thereof, and a funnel 805 including a neck 804.

On an inner surface of the effective display section 801 of the panel 803, a phosphor screen 806 is provided. The phosphor screen 806 includes three color phosphor elements respectively providing red (R), green (G) and blue (B) light, which are arranged two-dimensionally. A mask frame 810 is engaged with the panel 803 so as to face the phosphor screen 806 by a mask frame supporting device described later. The mask frame 810 includes a frame 109 and a substantially quadrangular mask 108 attached to the frame 109. The mask 108 has a gradual curved surface, which has a plurality of electron beam transmission holes (or slits) 807.

Figure 8C:
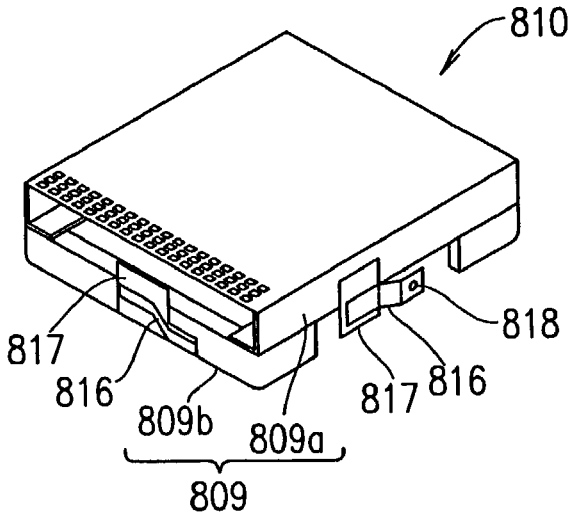
FIG. 8C shows a structure of the mask frame shown in FIG. 8A.

FIG. 8C is an isometric view of the mask frame 810. As shown in FIG. 8C, the frame 809 of the mask frame 810 includes two first shafts 809*a* and two second shafts 809*b*. The first shafts 809*a* each have an L-shaped cross-section and are formed of an Fe-Cr-Mo alloy. The two second shafts 809*b* each have a generally U-shaped or polygonal cross-section and are formed of an Fe-Cr-Mo alloy. The first shafts 801*a* and the second shafts 809*b* are firmly fixed to each other by welding. The mask 808 is welded to and extended between the two first shafts 809*a*. The frame 809 is provided with an inner magnetic shield 811 (FIG. 8A) for shielding an external magnetic field such as geomagnetism.

The neck 804 of the funnel 805 accommodates an electron gun 814 for emitting three electron beams 812, and a deflection yoke 813 is provided on an outer surface of the funnel 805. A color image is displayed by deflecting the three electron beams 812 by a magnetic field generated by the deflection yoke 813 and horizontally and vertically scanning the phosphor screen 806 with the three electron beams 812 through the mask 808.

The mask frame supporting device for engaging the mask frame 810 with the panel 803 will be described with reference to FIG. 8B. The mask frame supporting device includes stud pins 815 respectively attached to four inner faces of the side wall 802 of the panel 803, and elastic supports 816 respectively fixed to the two first shafts 809*a* and the two second shafts 809*b* of the frame 809. Each stud pin 815 is attached to a substantially central position of the respective inner face of the side wall 802, and each elastic support 816 is fixed to a substantially central position of the respective shaft 809*a* or 809*b*. The elastic supports 816 and the stud pins 815 are respectively detachably engaged with each other.

Referring to FIG. 8C, each elastic support 816 is fixed to the respective shaft 809*a* or 809*b* by, for example, welding through an attachment plate 817 at a position where the elastic support 816 can be accurately engaged with a respective stud pin 815. Each attachment plate 817 is directly fixed to the respective shaft 809*a* or 809*b* by welding.

Figure 9A:
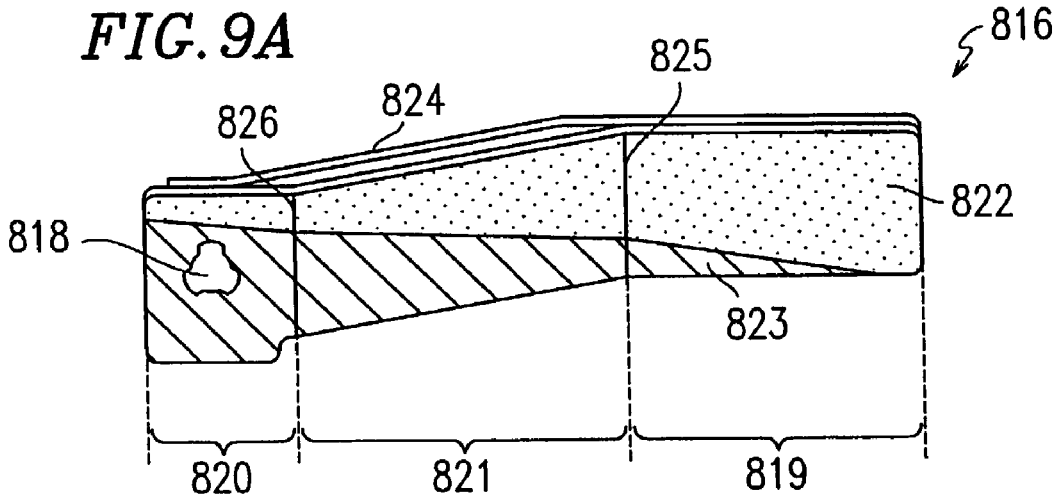
FIG. 9A is a schematic view of an elastic support in the cathode ray tube in Example 7.
Figure 9B:
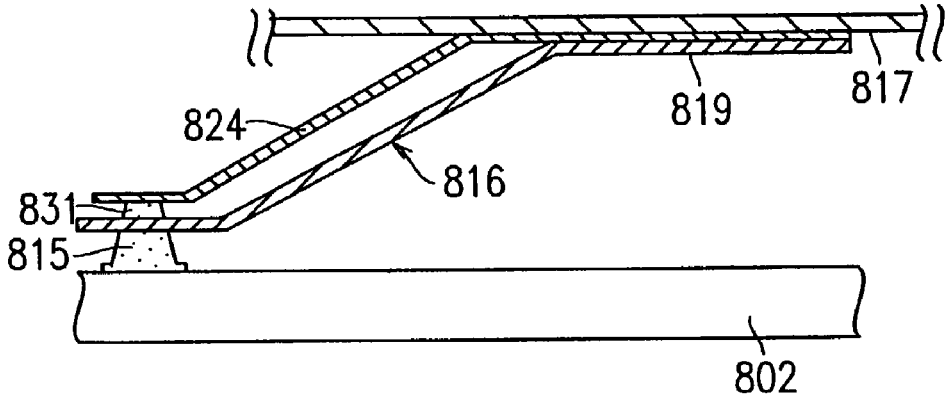
FIG. 9B is a plan view of the elastic support in the cathode ray tube in Example 7.

FIG. 9A is a front view of the elastic support 816, and FIG. 9B is a plan view of the elastic support 816. The description below will be done regarding one elastic support 816 for convenience unless specified otherwise.

As shown in FIGS. 9A and 9B, the elastic support 816 is a strip-like shaped plate having a thickness of about 1.2 mm and is bent at bending edges 825 and 826. The elastic support 816 includes a fixing portion 819 to be fixed to the attachment plate 817, an engagement portion 820 having an engaging hole 818 through which the stud pin 115 is inserted, and a connection portion 821 for connecting the fixing portion 819 and the engagement portion 820 together. The fixing portion 819 and the connection portion 821 are distinguished from each other by the bending edge 825, and the connection portion 821 and the engagement portion 820 are distinguished from each other by the bending edge 826. The elastic support 816 has a bimetal structure including a metal piece 822 formed of a metal having a relatively large coefficient of thermal expansion (for example, stainless steel) and a metal piece 823 formed of a metal having a relatively small coefficient of thermal expansion (for example, an Fe-Ni alloy, such as Invar). The metal pieces 822 and 823 are superimposed on each other by welding.

During the operation of the cathode ray tube 800, the mask frame 810 is heated and expanded by the scanning of the electron beams 812 (FIG. 8A). In this case, the relative positions between the electron beam transmission holes 807 and the phosphor screen 806 may be undesirably shifted from each other by the expansion of the mask frame 810, which may cause mislanding of the electron beams 812 (this phenomenon is referred to as "doming"). At this point, the temperature of the elastic supports 816 is also raised. Accordingly, the bimetal structure of the elastic supports 816 can adjust the position of the mask frame 810 to compensate for the doming.

It is not necessary to provide the bending edges 825 and 826. Even in the structure where no bending edge is provided, the engagement portion 820 and the connection portion 821 can be distinguished from the fixing portion 819 as follows. When the stud pin 815 is inserted through the engaging hole 818, an area in the vicinity of the engaging hole 818 becomes substantially parallel to the attachment plate 817 due to the elasticity of the elastic support 816. This area can be identified as the engagement portion 820. The area between the fixing portion 819 and the engagement portion 820 is inclined with respect thereto. This inclined area can be identified as the connection portion 821.

The elastic support 816 includes an elastic portion 824. The elastic portion 824 is a metal plate rolled into a leaf spring shape. One of two ends of the elastic portion 824 is fixed to the fixing portion 819 by welding. As best shown in FIG. 9B, the elastic portion 824 is sandwiched between the fixing portion 819 and the attachment plate 817. The other end of the elastic portion 824 is constantly in contact with a tip 831 of the stud pin 815 when the stud pin 815 is inserted through the engaging hole 818. Accordingly, when the mask frame 810 (FIG. 8A) vibrates in axial directions of the cathode ray tube 800 (in directions indicated by the two-headed arrow B1 in FIG. 8A, i.e., in directions perpendicular to the sheet of FIG. 9B) and directions parallel to the sheet of FIG. 9B, tip 831 of the stud pin 815 rubs against the elastic portion 824. At this point, vibration energy is converted into friction energy, and thus the vibration of the mask frame 810 is rapidly attenuated.

The cathode ray tube 800 having the above-described structure was incorporated into a commercially available TV. Vibration of a speaker was applied to the cathode ray tube 800 as in Example 1, and no degradation of color purity was observed. The reason is considered to be the following. When the mask frame 810 was vibrated due to the vibration of the speaker, the elastic portion 824 of each elastic support 816 rubbed against the tip 831 of a respective stud pin 815, and the friction between the elastic portion 824 and the tip 831 rapidly attenuated the vibration, thus preventing degradation of color purity.

Each elastic support 816 has a thickness of about 1 mm or more, preferably about 1.2 mm or more, and in consideration of the practical spring coefficient and material costs, about 3 mm or less. The elastic portion 824 preferably has a smaller thickness than the other portions of the elastic support 816 in order to have an appropriate level of elasticity. The elastic portion 824 preferably has a thickness of about 0.05 mm or more and about 0.5 mm or less. The elastic portion 824 may have a bimetal structure like the elastic support 816.

A thousand or more cathode ray tubes 800 in Example 7 were produced, and no trouble was experienced in detaching the mask frame 810 from the panel 803 during the process of forming the phosphor layer, such that the yield of the cathode ray tube 800 was 100%.

EXAMPLE 8

Figure 10A:
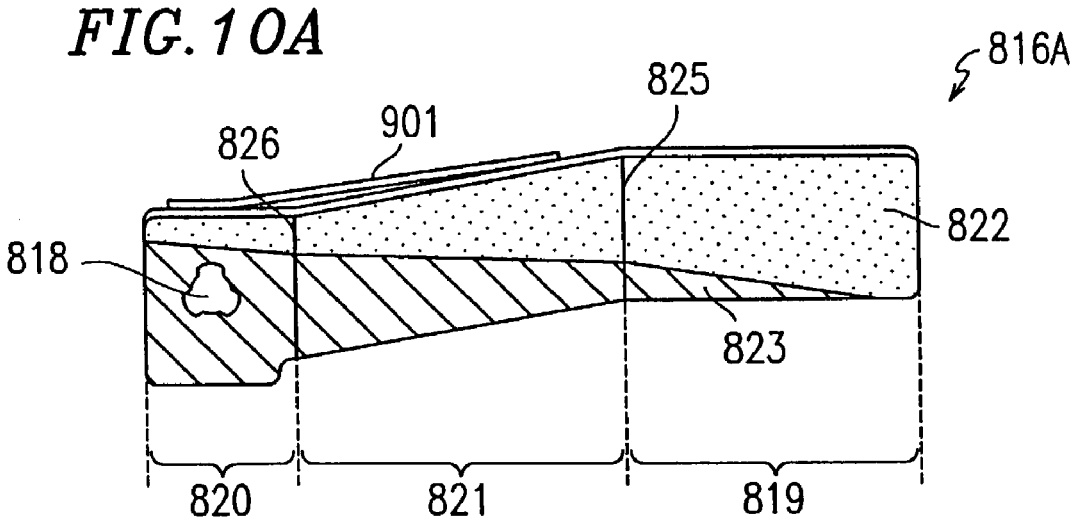
FIG. 10A is a schematic view of an elastic support in a cathode ray tube in Example 8.
Figure 10B:
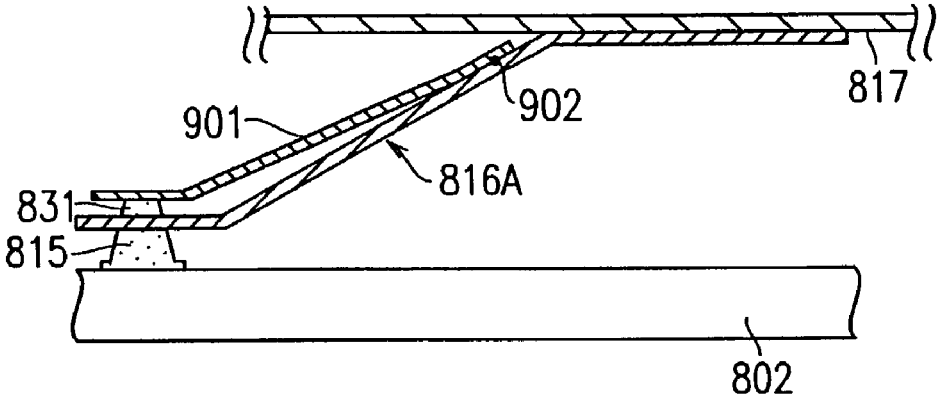
FIG. 10B is a plan view of the elastic support in the cathode ray tube in Example 8.

In Example 8 according to the present invention, a cathode ray tube having the structure shown in FIGS. 8A through 8C includes elastic supports 816A shown in FIGS. 10A and 10B instead of the elastic supports 816 shown in FIGS. 9A and 9B. Identical elements previously discussed with respect to FIGS. 9A and 9B bear identical reference numerals and the descriptions thereof will be omitted. The description below will be done regarding one elastic support 816A for convenience unless specified otherwise.

The elastic support 816A includes an elastic portion 901 having a different structure from that of the elastic portion 824. The elastic portion 901 is a metal plate bent into a leaf spring shape. One of two ends of the elastic portion 901 is fixed to the connection portion 821 at a welding point 902 by welding. As in the structure shown in FIG. 9B, when the stud pin 815 is inserted through the engaging hole 818, the tip 831 of the stud pin 815 is constantly in contact with the elastic portion 901.

When the mask frame 810 (FIG. 8A) vibrates in directions perpendicular to the sheet of FIG. 10B and directions parallel to the sheet of FIG. 10B, the tip 831 of the stud pin 815 rubs against the elastic portion 901 to cause friction. Thus, the vibration of the mask frame 810 is rapidly attenuated.

The cathode ray tube including the elastic supports 816A was incorporated into a commercially available TV, and vibration of the speaker was applied. No degradation of color purity was observed. The thickness of each portion of the elastic support 816A is the same as that of the elastic support 816 in Example B.

EXAMPLE 9

Figure 11A:
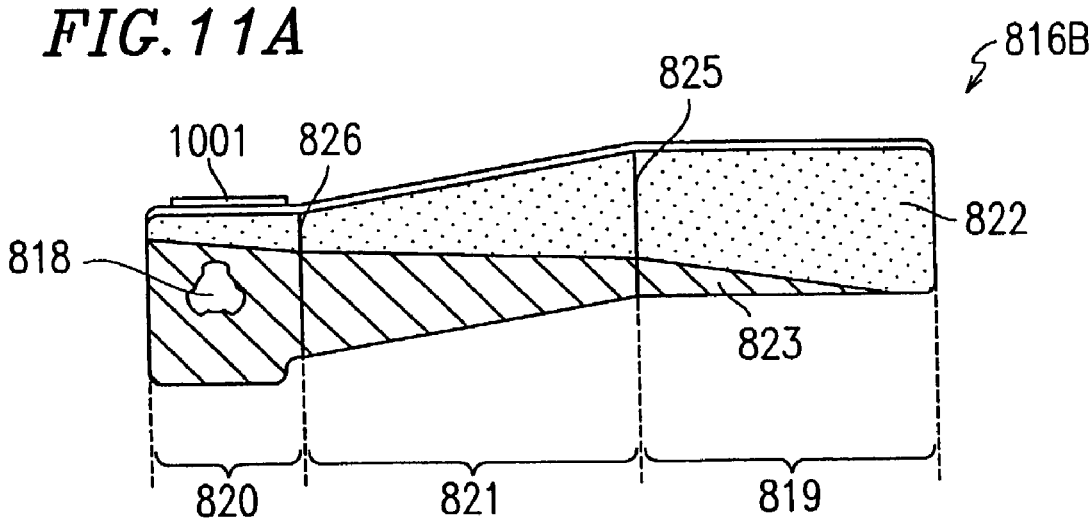
FIG. 11A is a schematic view of an elastic support in a cathode ray tube in Example 9.
Figure 11B:
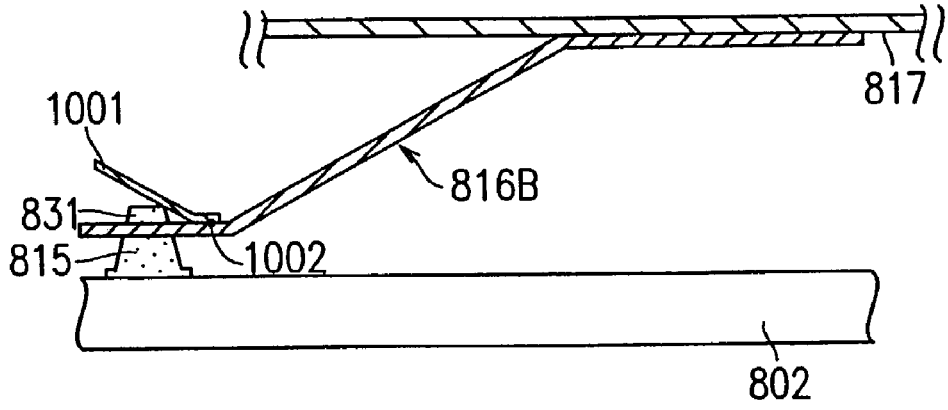
FIG. 11B is a plan view of the elastic support in the cathode ray tube in Example 9.

In Example 9 according to the present invention, a cathode ray tube having the structure shown in FIGS. 8A through 8C includes elastic supports 816B shown in FIGS. 11A and 11B instead of the elastic supports 816 shown in FIGS. 9A and 9B. Identical elements previously discussed with respect to FIGS. 9A and 9B bear identical reference numerals and the descriptions thereof will be omitted. The description below will be done regarding one elastic support 816B for convenience unless specified otherwise.

The elastic support 816B includes an elastic portion 1001 having a different structure from that of the elastic portion 824. The elastic portion 1001 is a metal plate, one of two ends of which is fixed to the engagement portion 820 at a welding point 1002 by welding. As in the structure shown in FIG. 9B, when the stud pin 815 is inserted through the engaging hole 818, the tip 831 of the stud pin 815 is constantly in contact with the elastic portion 901.

When the mask frame 810 (FIG. 8A) vibrates in directions perpendicular to the sheet of FIG. 11B and directions parallel to the sheet of FIG. 11B, the tip 831 of the stud pin 815 rubs against the elastic portion 1001 to cause friction. Thus, the vibration of the mask frame 810 is rapidly attenuated.

The cathode ray tube including the elastic supports 816B was incorporated into a commercially available TV, and vibration of the speaker was applied. No degradation of color purity was observed. The thickness of each portion of the elastic supports 816B is the same as that of the elastic support 816.

Figure 23A:
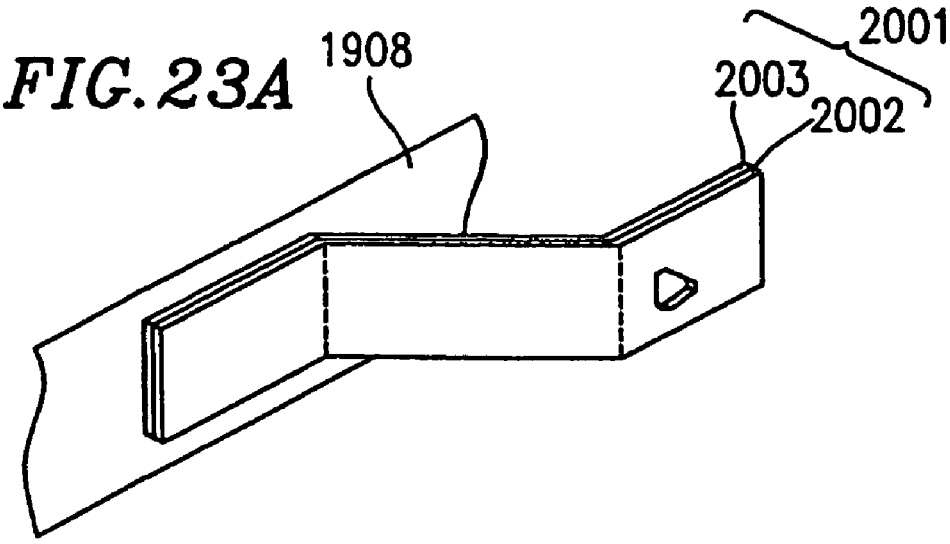
PRIOR ART FIG. 23A
FIG. 23A is a schematic view of another conventional elastic support.
Figure 23B:
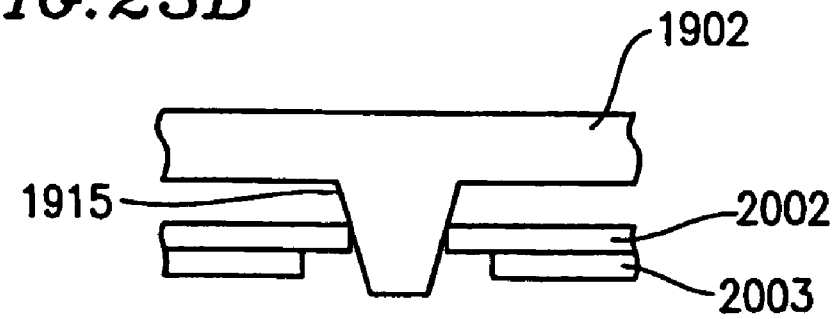
PRIOR ART FIG. 23B
FIG. 23B is a cross-sectional view of the another conventional elastic support shown in FIG. 23A.

In Examples 1 through 9, the area causing friction is not as large as in the conventional elastic supports 2001 (FIGS. 23A and 23B) and the elastic portion and the elastic support have different shapes. Accordingly, even small vibration causes friction, such that the vibration restriction effect is satisfactorily large.

EXAMPLE 10

Figure 12A:
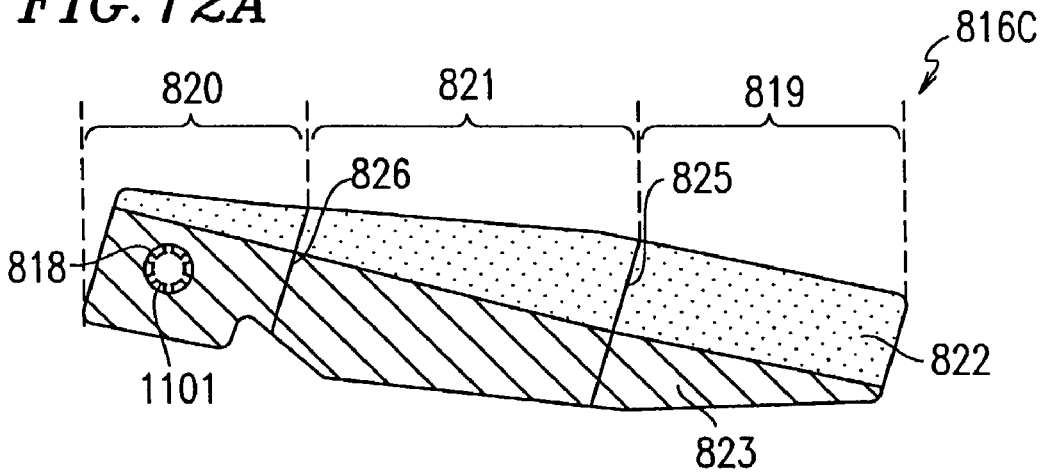
FIG. 12A is a schematic view of an elastic support in a cathode ray tube in Example 10.
Figure 12B:
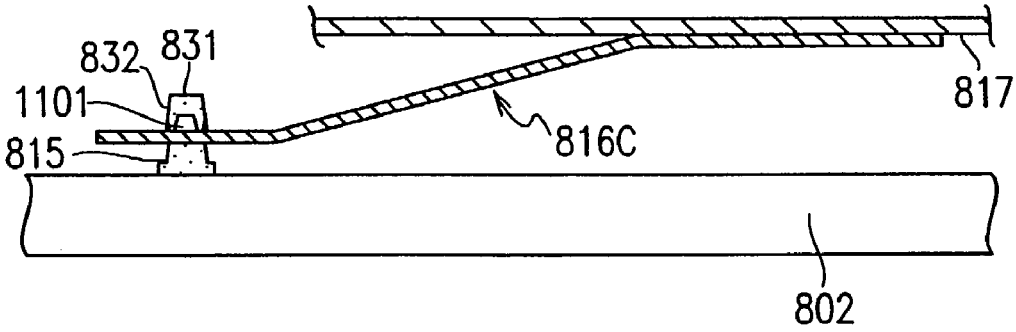
FIG. 12B is a plan view of the elastic support in the cathode ray tube in Example 10.

In Example 10 according to the present invention, a cathode ray tube having the structure shown in FIGS. 8A through 8C includes elastic supports 816C shown in FIGS. 12A and 12B instead of the elastic supports 816 shown in FIGS. 9A and 9B. Identical elements previously discussed with respect to FIGS. 9A and 9B bear identical reference numerals and the descriptions thereof will be omitted. The description below will be done regarding one elastic support 816C for convenience unless specified otherwise.

The elastic supports 816C does not include any elastic portion but includes a plurality of sliding pieces 1101 formed by raising an area surrounding the engaging hole 818. The plurality of sliding pieces 1101 form a funnel shape together. When the stud pin 815 is inserted through the engaging hole 818, a side circumferential surface 832 of the stud pin 815 is constantly in contact with the plurality of sliding pieces 1101.

When the mask frame 810 (FIG. 8A) vibrates in directions in directions perpendicular to the sheet of FIG. 12B and directions parallel to the sheet of FIG. 12B, the side circumferential surface 832 of the stud pin 815 rubs against the plurality of sliding pieces 1101 to cause friction. Thus, the vibration of the mask frame 810 is rapidly attenuated.

The cathode ray tube including the elastic supports 816C was incorporated into a commercially available TV, and vibration of a speaker was applied as in Example 10. No degradation of color purity was observed. The reason for this is considered to be the following. When the mask frame 810 is vibrated in the axial directions (directions indicated with the double-headed arrow B1 in FIG. 8A, i.e., the directions perpendicular to the sheet of FIG. 12B) by the vibration of the speaker, the sliding pieces 1101 of each elastic support 816C rubbed against the side circumferential surface 832 of a respective stud pin 815, and the friction between the sliding pieces 1101 and the side circumferential surface 832 rapidly attenuated the vibration, thus preventing degradation of color purity.

The plurality of sliding pieces 1101 preferably have an identical thickness as that of the elastic support 816C. Each sliding piece 1101 preferably has a length of about 0.5 mm or more and about 2.5 mm or less. When the sliding piece 1101 is shorter than about 0.5 mm, the effect is reduced. When the sliding piece 1101 is longer than about 2.5 mm, the sliding piece 1101 is locked by the stud pin 815 while the elastic support 816C is attached to and detached from the mask frame 810 repeatedly, thus undesirably resulting in deformation or destruction of the sliding piece 1101.

EXAMPLE 11

Figure 13A:
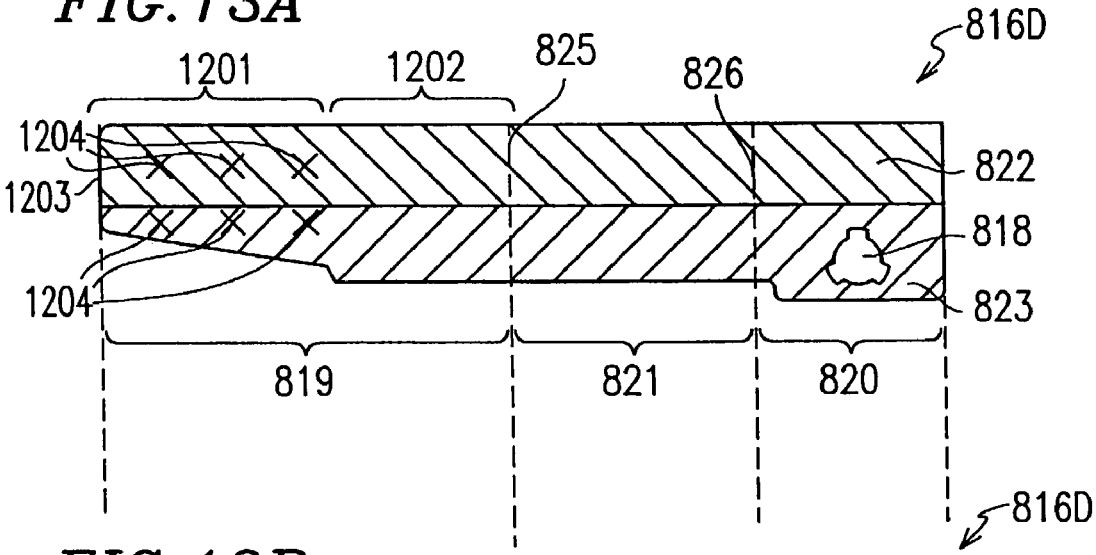
FIG. 13A is a schematic view of the elastic support in the cathode ray tube in Examples 11 through 13 and 20.
Figure 13B:
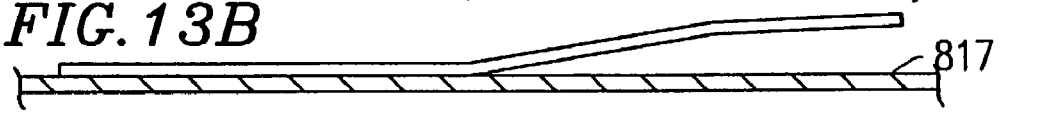
FIG. 13B is a plan view of the elastic support in the cathode ray tube in Examples 11 through 13 and 20.

In Example 11 according to the present invention, a cathode ray tube having the structure shown in FIGS. 8A through 8C includes elastic supports 816D shown in FIGS. 13A and 13B instead of the elastic supports 816 shown in FIGS. 9A and 9B. Identical elements previously discussed with respect to FIGS. 9A and 9B bear identical reference numerals and the descriptions thereof will be omitted. The description below will be done regarding one elastic support 816D for convenience unless specified otherwise.

The elastic supports 816D includes a fixing portion 819 having an area S1, an engagement portion 820 having an area S3, and the connection portion 821 having an area S2. The area S1 of fixing portion 819 is larger than each of the area S3 of the engagement portion 820 and the area S2 of the connection portion 821. That is, areas S1, S2 and S3 satisfy the relationships of S1≧S2 and S1≧S3.

The fixing portion 819 is fixed to the attachment plate 817 by spot welding at welding points 1204 indicated with an "X" in FIG. 13. The locations of the welding points 1204 are determined as follows. An approximate half of the fixing portion 819 is defined as an area 1201 and another approximate half of the fixing portion 819 is defined as an area 1202. The welding points 1204 are all located in the area 1201 which is farther from the bending edge 825 than the area 1202. The area 1201 will be referred to as a "welded area", and the area 1202 will be referred to as a "non-welded area".

The cathode ray tube including the elastic supports 816D was incorporated into a commercially available TV, and vibration of a speaker was applied as in Example 1. No degradation of color purity was observed. The reason for this is considered to be the following. In the non-welded area 1202 in which the fixing portion 819 is not welded to the attachment plate 817, surfaces of the fixing portion 819 and the attachment plate 817 are constantly in contact with each other. When the mask frame 810 vibrates the axial directions (directions indicated with the double-headed arrow B1 in FIG. 8A, i.e., the directions perpendicular to the sheet of FIG. 13B) and directions parallel to the sheet of FIG. 13B, the contacting surfaces of the fixing portion 819 and the attachment plate 817 rub against each other in the non-welded area 1202 to cause friction. Thus, the vibration of the mask frame 810 is rapidly attenuated.

In order to confirm this, a comparative cathode ray tube (not shown; referred to as "cathode ray tube (2)" for convenience) in which the entire fixing portion is welded to the attachment plate was produced and subjected to the same test. A degradation of color purity was observed. Even after the vibration of the speaker was stopped, the degradation of color purity caused by the vibration of the mask frame was still observed for several seconds or longer.

Then, after the cathode ray tube (2) was operated, the mislanding of the electron beams over-time was measured. 120 minutes after the cathode ray tube (2) was turned on, the mislanding was about 70 μm. The cathode ray tube including the elastic supports 816D was subjected to the same doming test. 120 minutes after the cathode ray tube was turned on, the mislanding of the electron beams was as small as about 20 μm. The reason for this is considered to be the following. In the cathode ray tube including the elastic supports 816D, the distance between the welded area 1201 of the elastic support 816D and the engaging hole 818, i.e., the operating length of the bimetal structure, is relatively long. Accordingly, even a slight temperature rise caused the position of the mask frame 810 (FIG. 8A) to be corrected. In the cathode ray tube (2), by contrast, the entire fixing portion 819 is a welded area and thus the operating length of the bimetal structure is shorter than that of the elastic support 816D. Therefore, the position of the mask frame 810 was not sufficiently corrected.

The cathode ray tube including the elastic supports 816D was subjected to a package dropping test in a similar manner to the manner of Example 6. No degradation of color purity was observed.

The area of the welded area 1201 needs to be about 60% or smaller of the entire area of the fixing portion 819 in order to achieve both the restriction of the vibration and the compensation for doming as described above. The area of the welded area 1201 needs to be about 20% or larger of the entire area of the fixing portion 819. When the area of the welded area 1201 is smaller than 20% of the entire area of the fixing portion 819, there were cases where the welded area 1201 was detached from the attachment plate 817 in the package dropping test.

The same effect can be achieved even when the elastic support 816D is provided on only each of the second shafts 809*b* (FIG. 8B) and an elastic support which does not satisfy the relationships of S1≧S2 and S1≧S3 is provided on each of the first shafts 809*a*. The same effect can also be achieved even when the elastic support 816D is provided on only each of the first shafts 809*a* (FIG. 8B) and an elastic support which does not satisfy the relationships of S1≧S2 and S1≧S3 is provided on each of the second shafts 809*b*.

EXAMPLE 12

In Example 12 according to the present invention, a cathode ray tube having the structure shown in FIGS. 8A through 8C includes elastic supports 816D shown in FIGS. 13A and 13B, instead of the elastic supports 816 shown in FIGS. 9A and 9B. Identical elements previously discussed with respect to FIGS. 9A and 9B bear identical reference numerals and the descriptions thereof will be omitted. The description below will be done regarding one elastic support in Example 12 for convenience unless specified otherwise.

In the elastic support 816D in Example 12, the area S1 of the fixing portion 819, the area S2 of the connection portion 821 and the area S3 of the engagement portion 820 satisfy the relationship of S1≧S2≧S3. In one example, S1=10 $cm^2$, S2=8.5 $cm^2$, and S3=5 $cm^2$. The area S3 does not include the area of the engaging hole 818. The area 1201 occupies about 40% of the fixing portion 819.

Four elastic supports 816D in Example 12 are respectively located on the two first shafts 809*a* and two second shafts 809*b* of the frame 809 (FIG. 8B), each at an approximately central position. The mask frame 810 weighs about 4 kg.

The cathode ray tube including the elastic supports 816D in Example 12 was incorporated into a commercially available TV, and a package dropping test was performed as in Example 6. In each of single-color images of R, G and B, no degradation of color purity was observed.

For comparison, a comparative cathode ray tube (not shown: referred to as "cathode ray tube (3)" for convenience) including elastic supports which are the same as the elastic supports 816D in Example 12 except that the relationship of S1≧S2≧S3 is not satisfied with S1=4.5 $cm^2$, S2=8.5 $cm^2$, and S3=5 $cm^2$. The comparative cathode ray tube (3) was incorporated into a commercially available TV and subjected to the same package dropping test. In each of single-color images of R, G and B displayed after that, degradation of color purity was observed in a peripheral area of the effective display area. This demonstrates that mislanding of the electron beams occurred.

In the case of the cathode ray tube including the elastic supports 816D in Example 12, it is considered that even when the mask frame 810 significantly swings due to a strong external impact to apply a strong force to the fixing portion 819 of the elastic support 816D, the mask frame 810 is returned to its original position without the fixing portion 819 being detached from the mask frame 810 or without the elastic support 816D being twisted by plastic deformation at the border between the fixing portion 819 and the connection portion 821. Accordingly, mislanding of the electron beams 812 (FIG. 8A) did not occur and thus no degradation of color purity occurred.

In the comparative cathode ray tube (3), the fixing portion was detached from the mask frame despite the welding or the elastic support was twisted by plastic deformation at the border between the fixing portion and the connection portion. Accordingly, the mask frame could not return to its original position and thus degradation of color purity occurred.

Based on these results, when a strong impact is applied to a cathode ray tube from outside, a strong force is applied to the fixing portion of the elastic support by the movement of the mask frame. When the area S1 of the fixing portion is smaller than the area S3 of the engagement area or the area S2 of the connection portion, the fixing portion cannot withstand the force and is detached from the mask frame despite the welding, or plastic deformation of the elastic support occurs at the border between the fixing portion and the connection portion. Thus, the relative positions of the mask 808 and the phosphor screen 806 are likely to be offset. Accordingly, it is important to make the area S1 of the fixing portion larger than the area S3 of the engagement portion and also the area S2 of the connection portion and also to make the area S1 of the fixing portion sufficiently large to be strong enough against the weight of the mask frame, in order to prevent mislanding of the electron beams against an external impact. A necessary area of the fixing portions can be determined in terms of the ratio of the total area of the fixing portions 819 (in the case of FIGS. 8A and 8B, 10 $cm^2 \times 4 = 40\ cm^2$) with respect to the weight of the mask frame 810. Regarding the cathode ray tube in this example, the ratio of about 5 $cm^2$/kg is not preferable. When the ratio is about 10 $cm^2$/kg or more, degradation of color purity due to mislanding of the electron beams does not occur unless an exceptionally strong force is applied.

EXAMPLE 13

In Example 13 according to the present invention, a cathode ray tube having the structure shown in FIGS. 8A through 8C includes elastic supports 816D shown in FIGS. 13A and 13B, instead of the elastic supports 816 shown in FIGS. 9A and 9B. Identical elements previously discussed with respect to FIGS. 9A and 9B bear identical reference numerals and the descriptions thereof will be omitted. The description below will be done regarding one elastic support in Example 13 for convenience unless specified otherwise.

In the elastic support 816D in Example 13, S1=5 $cm^2$, S2=5 $cm^2$, and S3=2.5 $cm^2$. S3 does not include the area of the engaging hole 818. The area S1 of the fixing portion 819, the area S2 of the connection portion 821 and the area S3 of the engagement portion 820 satisfy the relationships of $S1 \geqq S2$ and $S1 \geqq S3$. The thickness of the elastic support 816D in Example 13 is about 1.2 mm, and the weight of the mask frame 810 is about 4 kg.

The cathode ray tube including the elastic supports 816D in Example 13 was incorporated into a commercially available TV, and a package dropping test was performed as described in Example 12. No degradation of color purity due to the mislanding of the electron beams was observed.

In the case where the welding surfaces of the fixing portion 819 and the attachment plate 817 were roughened or scratched to have a rough surface portion by pressing or filing before welded, no degradation of color purity was observed even in a package dropping test with a larger acceleration. The difference of the top and bottom of the rough surface is preferably about 10 μm or more and about 500 μm or less.

A preferable ratio of the total area of the fixing portions 819 with respect to the weight of the mask frame 810 is examined as in Example 12. It is considered that the ratio is preferably about 5 $cm^2$/kg or more, and more preferably about 10 $cm^2$/kg or more.

EXAMPLE 14

Figure 14:
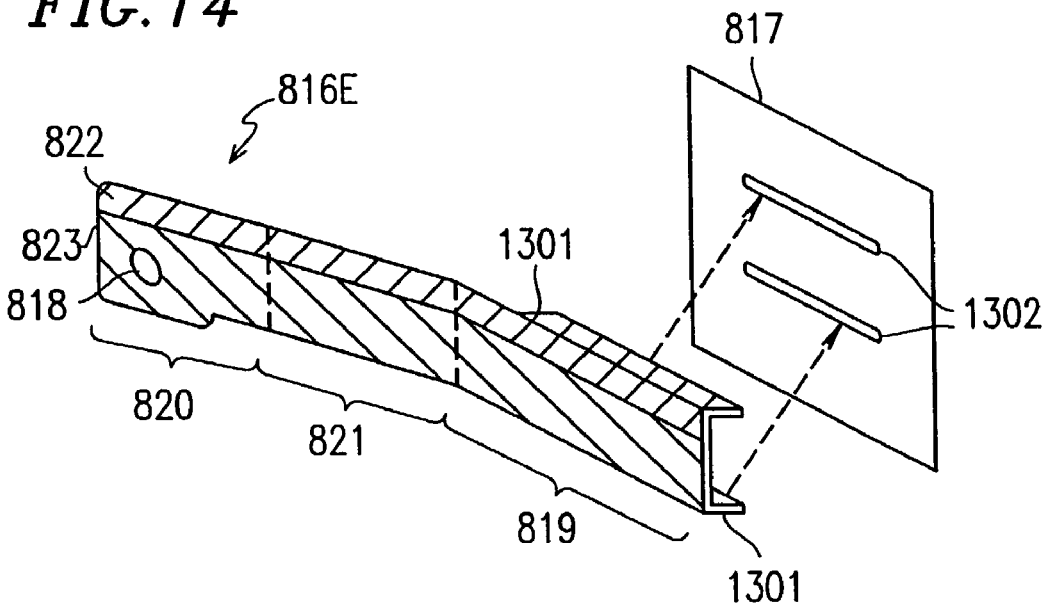
FIG. 14 is a schematic view of an elastic support in a cathode ray tube in Example 14.

In Example 14 according to the present invention, a cathode ray tube having the structure shown in FIGS. 8A through 8C includes elastic supports 816E shown in FIG. 14 instead of the elastic supports 816 shown in FIGS. 9A and 9B. Identical elements previously discussed with respect to FIGS. 9A and 9B bear identical reference numerals and the descriptions thereof will be omitted. The description below will be done regarding one elastic support 816E for convenience unless specified otherwise.

In the elastic support 816E, the area S1 of the fixing portion 819, the area S2 of the connection portion 821 and the area S3 of the engagement portion 820 do not satisfy the relationship of $S1 \geqq S2 \geqq S3$. The area S1=7 $cm^2$, S2=8 $cm^2$, and S3=5 $cm^2$. S3 does not include the area of the engaging hole 818.

The fixing portion 819 includes bent portions 1301 at both of two ends thereof. The bent portions 1301 are bent towards the attachment plate 817. The attachment plate 817 has holes 1302 corresponding to the bent portions 1301. The bent portions 1301 are inserted through the holes 1302 and then the fixing portion 819 and the attachment plate 817 are welded together. The thickness of the elastic support 816E is about 1.3 mm, and the weight of the mask frame 810 is about 10 kg.

The cathode ray tube including the elastic supports 816E was incorporated into a commercially available TV, and a package dropping test was performed as described in Example 12. No degradation of color purity due to the mislanding of the electron beams was observed.

By providing the bent portions 1301 for the elastic support 816E, the resistance against an impact can be increased even though the areas S1, S2 and S3 do not satisfy the relationship of $S1 \geqq S2 \geqq S3$.

In the case where the bent portions 1301 are inserted through the holes 1302 and then the bent portions 1301 are further bent to be parallel to the attachment plate 817 and welded with the attachment plate 817, the resistance against an impact is further increased.

EXAMPLE 15

Figure 15A:
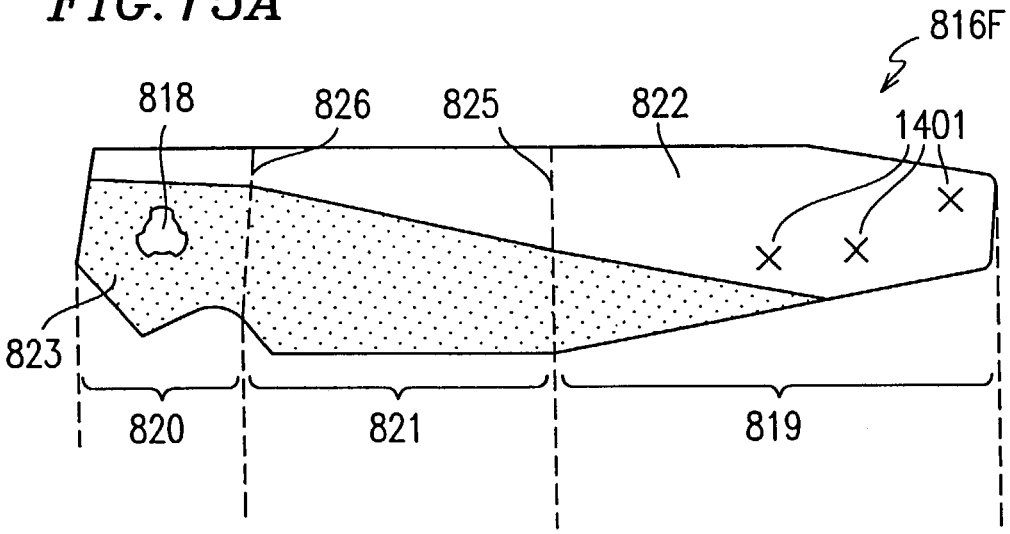
FIG. 15A is a schematic view of an elastic support in a cathode ray tube in Example 15.
Figure 15B:
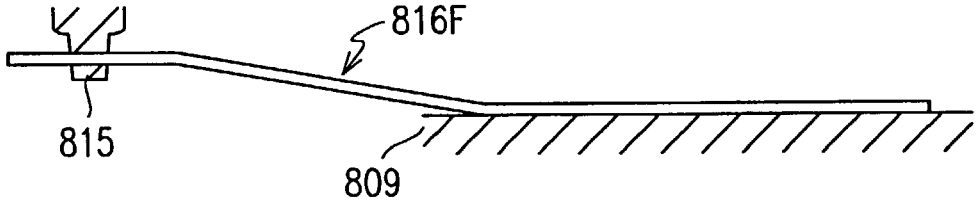
FIG. 15B is a plan view of the elastic support in the cathode ray tube in Example 15.

In Example 15 according to the present invention, a cathode ray tube having the structure shown in FIGS. 8A through 8C includes elastic supports 816F shown in FIGS. 15A and 15B, instead of the elastic supports 816 shown in FIGS. 9A and 9B, on the second shafts 809*b* (FIG. 8B). Identical elements previously discussed with respect to FIGS. 9A and 9B bear identical reference numerals and the descriptions thereof will be omitted. The description below will be done regarding one elastic support 816F for convenience unless specified otherwise.

In the elastic support 816F, the area S1 of the fixing portion 819, the area S2 of the connection portion 821 and the area S3 of the engagement portion 820 satisfy the relationship of $S1 \geqq S2 \geqq S3$. The area S1=9.5 $cm^2$, S2=9

$cm^2$, and S3=3.4 $cm^2$. S3 does not include the area of the engaging hole 818. As shown in FIG. 15A, the fixing portion 819 is welded with the attachment plate (not shown) at welding points 1401 (indicated with an "X"). The welding points 1401 are distributed in an area closer to one end of the fixing portion 819 from the center of the fixing portion 819.

The metal piece 822 formed of stainless steel is longer than the metal piece 823 formed of Invar having a smaller coefficient of thermal expansion than that of stainless steel. Due to such a structure, the metal piece 822 expands more due to a temperature rise than the case where the metal pieces 822 and 823 have the same length. Therefore, satisfactory compensation for doming can be expected.

On the first shafts 809*a* (FIG. 8B), the elastic supports having the same structure as that of the elastic supports 816F except that the areas S1, S2 and S3 do not satisfy the relationship of S1≧S2≧S3. The area S1=7 $cm^2$, S2=8 $cm^2$, and S3=3.4 $cm^2$. S3 does not include the area of the engaging hole 818. The metal piece 822 formed of stainless steel is longer than the metal piece 823 formed of Invar. The welding points 1401 are distributed in an area closer to one end of the fixing portion 819 from the center of the fixing portion 819. Both types of elastic supports have a thickness of about 1.2 mm, and the weight of the mask frame 810 is 4 kg.

The cathode ray tube including the elastic supports as described above was incorporated into a commercially available TV, and vibration of a speaker was applied as in Example 1 to the cathode ray tube. No degradation of color purity due to the mislanding of the electron beams was observed.

The mislanding of the electron beams measured 120 minutes after the cathode ray tube was turned on was as small as about 15 μm. After a package dropping test performed as in Example 12, no degradation of color purity due to the mislanding of the electron beams was observed.

EXAMPLE 16

Figure 16A:
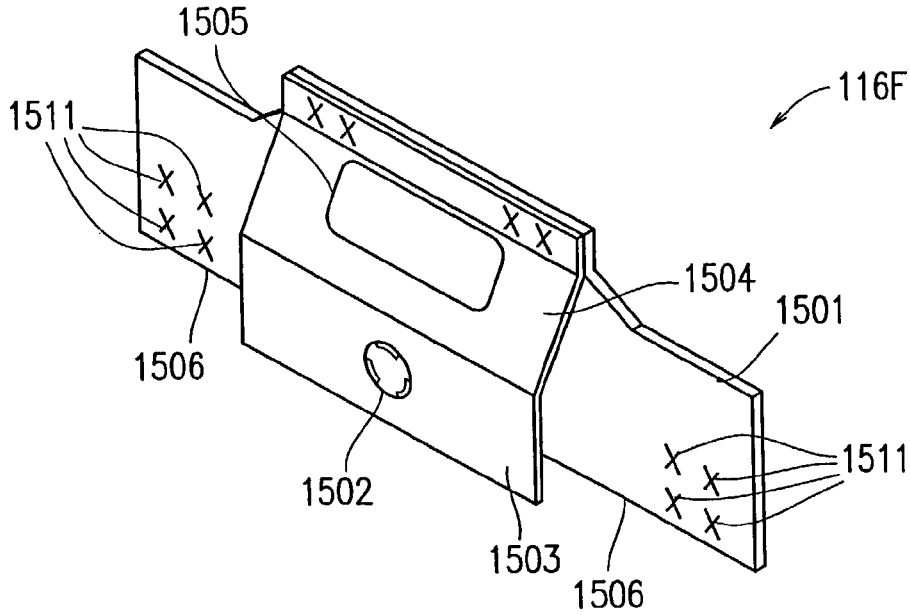
FIG. 16A is a schematic view of an elastic support in a cathode ray tube in Examples 16, 17 and 21.
Figure 16B:
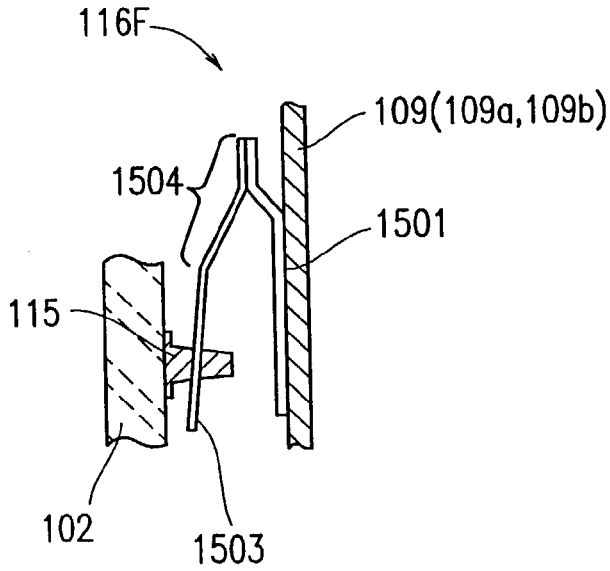
FIG. 16B is a plan view of the elastic support in the cathode ray tube in Examples 16, 17 and 21.

In Example 16 according to the present invention, a cathode ray tube having the structure shown in FIGS. 1A through 1C includes elastic supports 116F shown in FIGS. 16A and 16B instead of the elastic supports 116 shown in FIGS. 2A and 2B. Identical elements previously discussed with respect to FIGS. 2A and 2B bear identical reference numerals and the descriptions thereof will be omitted. The description below will be done regarding one elastic support 116F for convenience unless specified otherwise.

As best shown in FIG. 16B, the elastic support 116F has a V-shaped cross-section. When the mask frame 110 (FIG. 1A) is heated and expanded by the scanning of the electron beams 112 during the operation of the cathode ray tube, the frame 109 presses the elastic supports 116F towards the side wall 102, which may undesirably offsets the relative positions of the electron beams 112 and the phosphor screen 106. The elastic support 116F has a V-shaped cross-section in order to automatically adjust the position of the mask frame 110 so that mislanding of the electron beams are prevented.

The elastic support 116F shown in FIGS. 16A and 16B includes a fixing portion 1501 having an area S1, an engagement portion 1503 having an area S3 and having an engaging hole 1502, and a connection portion 1503 having an area S2 and having a hole 1505. S1=22.5 $cm^2$, S2=4.5 $cm^2$, and S3=5 $cm^2$. S1 is the area which is in contact with the frame 109*b* or the attachment plate 117 (FIG. 1C), S2 does not include the area of the hole 1505, and S3 does not include the area of the engaging hole 1502. S1, S2 and S3 fulfill the relationships of S1≧S2 and S1≧S3. The fixing portion 1501 has a thickness of about 1 mm, and the connection portion 1504 and the engagement portion 1503 each have a thickness of about 0.5 mm. The weight of the mask frame 110 (FIG. 1A) is about 6.4 kg. The welding points 1511 of the fixing portion 1501 with the frame 109 or the attachment plate 117 are indicated with an "X". The welding points 1511 are distributed in areas closer to both of two ends 1506 of the fixing portion 1501 from the connection portion 1504.

The cathode ray tube including the elastic supports 116F was incorporated into a commercially available TV, and vibration of a speaker was applied as in Example 1. No degradation of color purity was observed. This is considered to be because vibration of the frame 110 was rapidly attenuated due to the friction between the fixing portion 1501 and the frame 109 in the area where the fixing portion 1501 is not welded to the frame 109.

A package dropping test was performed as in Example 12, and no degradation of color purity was observed.

For comparison, a comparative cathode ray tube (not shown; referred to as "cathode ray tube (4)" for convenience) including elastic supports which are the same as the elastic supports in Example 16 except that S1=7.5 $cm^2$, S2=8.0 $cm^2$ and S3=6.5 $cm^2$. The comparative cathode ray tube (4) was incorporated into a commercially available TV and subjected to a package dropping test. In each of single-color images of R, G and B displayed after that, degradation of color purity was observed in a peripheral area of the effective display area. This demonstrates that mislanding of the electron beams occurred.

The elastic support 116F in Example 16 provides the same effect in the case where the thickness of the fixing portion 1501 is more than about 1 mm, and the thickness of each of the connection portion 1504 and the engagement portion 1503 is about 0.3 mm or more and about 0.9 mm or less.

EXAMPLE 17

In Example 17 according to the present invention, cathode ray tubes having the structure shown in FIGS. 1A through 1C including the elastic supports having the structure of elastic supports 116F shown in FIGS. 16A and 16B were produced with the area S1 of the fixing portion 1501 being changed from 5 $cm^2$, 10 $cm^2$, 15 $cm^2$, to 20 $cm^2$. Ten cathode ray tubes were produced for each size of the fixing portion 1501. The cathode ray tubes were each incorporated into a commercially available TV and subjected to a package dropping test. The results are shown in Table 1.

TABLE 1

| CRT Sample No. | 3 | 4 | 5 | 6 |
|---|---|---|---|---|
| Area of fixing portion (S1) | 5 | 10 | 15 | 20 |
| Ratio of generation of degradation of color purity | 100 | 10 | 0 | 0 |

Based on the result shown in Table 1, it is understood that when the area S1 is 7.5 $cm^2$ or less, the ratio of generation of degradation of color purity is unacceptably high; when the area S1 is 10 $cm^2$ or more, the ratio of generation of degradation of color purity is 10% or less and acceptable; and when the area S1 is 15 $cm^2$ or more, there is no problem regarding the degradation of color purity.

As in Example 12, the total area of the fixing portions 1501 of the elastic supports 116F (in the case of FIG. 1B, S1×4) with respect to the weight of the mask frame 110 (FIG. 1A; 6.4 kg) is preferably about 5 $cm^2$/kg or more and more preferably about 10 $cm^2$/kg or more, based on the results shown in Table 1 and Example 16. Using this as a reference, an appropriate total area of the fixing portions can be found with respect to a mask frame of any weight.

EXAMPLE 18

Figure 17A:
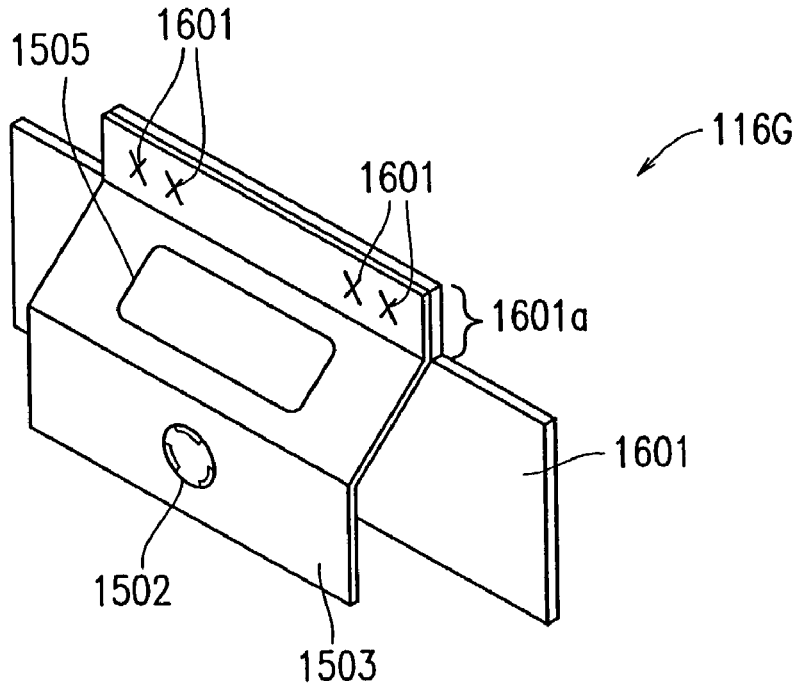
FIG. 17A is a schematic view of an elastic support in a cathode ray tube in Example 18.
Figure 17B:
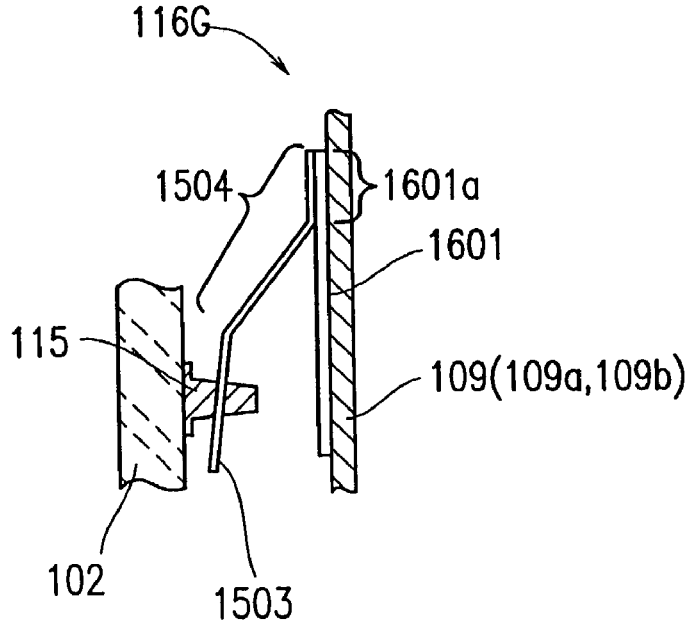
FIG. 17B is a plan view of the elastic support in the cathode ray tube in Example 18.

In Example 18 according to the present invention, a cathode ray tube having the structure shown in FIGS. 1A through 1C includes elastic supports 116G shown in FIGS. 17A and 17B instead of the elastic supports 116 shown in FIGS. 2A and 2B. Identical elements previously discussed with respect to FIGS. 2A and 2B and 16A and 16B bear identical reference numerals and the descriptions thereof will be omitted. The description below will be done regarding one elastic support 116G for convenience unless specified otherwise.

As best shown in FIG. 17B, the elastic support 116G includes a flat fixing portion 1601 including an area 1601*a* welded with the connection portion 1504. The elastic support 116G has a cuneiform cross-section. The welding points are indicated with an "X" in FIG. 17A. The weight of the mask frame 110 is 8 kg.

The cathode ray tubes in Example 18 including the elastic supports 116G shown in FIGS. 17A and 17B were produced with the area S1 of the fixing portion 1501 being changed from 5 $cm^2$, 10 $cm^2$, 15 $cm^2$, to 20 $cm^2$. Twenty cathode ray tubes were produced for each size of the fixing portion 1601. The cathode ray tubes were each incorporated into a commercially available TV and subjected to a package dropping test as in Example 12. The results are shown in Table 2.

TABLE 2

| CRT Sample No. | 7 | 8 | 9 | 10 |
|---|---|---|---|---|
| Area of fixing portion (S1) | 5 | 10 | 15 | 20 |
| Ratio of generation of degradation of color purity | 100 | 15 | 0 | 0 |

The total area of the fixing portions 1601 of the elastic supports 116G with respect to the weight of the mask frame 110 (FIG. 1A) is preferably about 5 $cm^2$/kg or more based on the results shown in Table 1, more preferably about 7.5 $cm^2$/kg or more.

EXAMPLE 19

Figure 18:
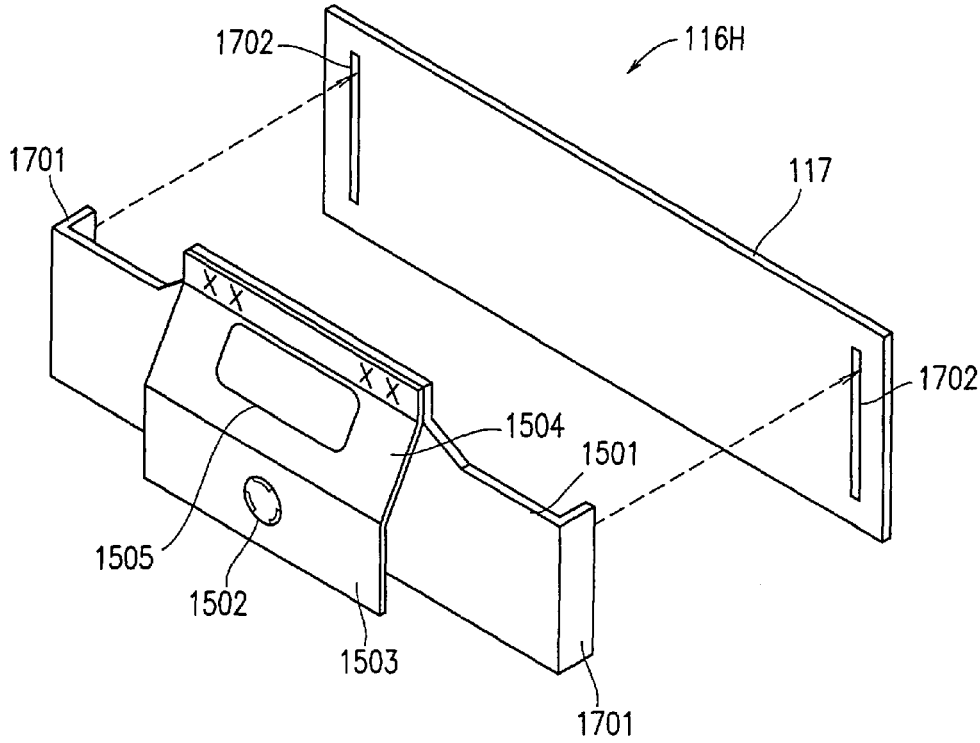
FIG. 18 is a schematic view of an elastic support in a cathode ray tube in Examples 19 and 21.

In Example 19 according to the present invention, a cathode ray tube having the structure shown in FIGS. 1A through 1C includes elastic supports 116H shown in FIG. 18 provided on the first shafts 109*a* (FIG. 1B). Along the second shafts 109*b*, the elastic supports 116F shown in FIGS. 16A and 16B are provided. The elastic description below will be done regarding one elastic support 116H for convenience unless specified otherwise.

The elastic support 116H includes a fixing portion 1501 including bent portions 1701 at both of two ends thereof. The bent portions 1701 are bent towards attachment plate 117. The fixing portion 1501 has an area S1 of 10 $cm^2$ (Table 1, sample no. 4). The attachment plate 117 has holes 1702 corresponding to the bent portions 1701.

The bent portions 1501 are inserted through the holes 1702, further bent outwards or inwards to be parallel to the attachment plate 117 and welded with the attachment plate 117. The remaining part of the fixing portion 1501 is fixed to the attachment plate 117 by welding.

Twenty cathode ray tubes in Example 19 were produced and each incorporated into a commercially available TV and subjected to a package dropping test as in Example 12. The ratio of generation of degradation of color purity was 0%.

EXAMPLE 20

Example 20 according to the present invention is directed to the cathode ray tube shown in FIGS. 8A through 8C including the elastic supports shown in FIGS. 13A and 13B and described in Example 11, 12 or 13. In each of these cathode ray tubes, the spring coefficient or the distance between the frame 809 and the stud pin 815 was changed so that the force of the stud pin 815 pressing the elastic support 816D through the engaging hole 818 was changed so as to be different for each of the four elastic supports 816D. The pressing force was not to exceed the range from about 5 N (newton) to about 100 N including about 5 N and about 100 N. When the force is less than 5 N, the engagement of the stud pin 815 and the engaging hole 818 is unstable, and when the force is more than 100 N, the force undesirably influences the shape of the frame 809.

The cathode ray tubes produced in this manner were each incorporated into a commercially available TV and vibration of a speaker was applied as in Example 1. The vibration amplitude was smaller than the case where the frame 809 is pressed by the same force at the four sides thereof. This is considered to have occurred for the following reason. Since the pressing force is different for each of the four sides, the internal stress is also different for each of the four sides. As a result, the resonance frequency is different for each of the four elastic supports 816D. Accordingly, the vibration of the frame 809 is constantly attenuated by at least one of the elastic supports 816D. Thus, resonance of the elastic supports 816D and the frame 809 is alleviated.

In the above example, the pressing force is made to be different for each of the four elastic supports 816D. Instead, the pressing force applied to the elastic supports 816D provided along the first shafts 809*a* can be made to be different from the pressing force applied to the elastic supports 816D provided on the second shafts 809*b*. In this case, it is effective to make the pressing force applied to the elastic supports 816D provided on the second shafts 809*b* 1.1 to 3 times larger than the pressing force applied to the elastic supports 816D provided on the first shafts 809*a* in order to alleviate a twisting vibration of the frame 809.

In order to set the pressing force in the above-described range, the spring coefficient of each elastic support 816D is preferably about 1 N/mm or more and about 25 N/mm or less. When the spring coefficient is less than about 1 N/mm, the rigidity of the elastic support 816D is too small to maintain the strength to engage the frame 809. When the spring coefficient is more than about 25 N/mm, the rigidity of the elastic support 816D is excessively strong and has an adverse influence on production.

EXAMPLE 21

Example 21 according to the present invention is directed to the cathode ray tube 100 shown in FIGS. 1A through 1C and respectively including the elastic supports 116F shown in FIGS. 16A and 16B described in Example 16 or the elastic supports 116H shown in FIG. 18A described in Example 19. In each of these cathode ray tubes, the relationship between the pressing force applied to the elastic supports and the vibration of the frame 109 was examined as described in Example 20. The same results as those in Example 20 were obtained.

In each of Examples 1 through 21, the mask main body, the frame and the elastic supports may be formed of other metals than those described in order to provide a similar effect. The number of the elastic supports provided to the frame is not limited to four, and may be three, five or more. The position at which each elastic support is attached is not limited to the center of the sides or the corners, and may be any position on a side. The elastic portion of the elastic support is not limited to be formed of one plate, and may be formed of a plurality of plates which are superimposed on one another. The elastic portion is not limited to have a flat surface, and may include a curved surface.

Each of the masks 108 and 808 may be a press mask, an aperture grill, or a shadow mask extended between the respective first shafts 109*a* and 809*a* of the frame.

Figure 19:
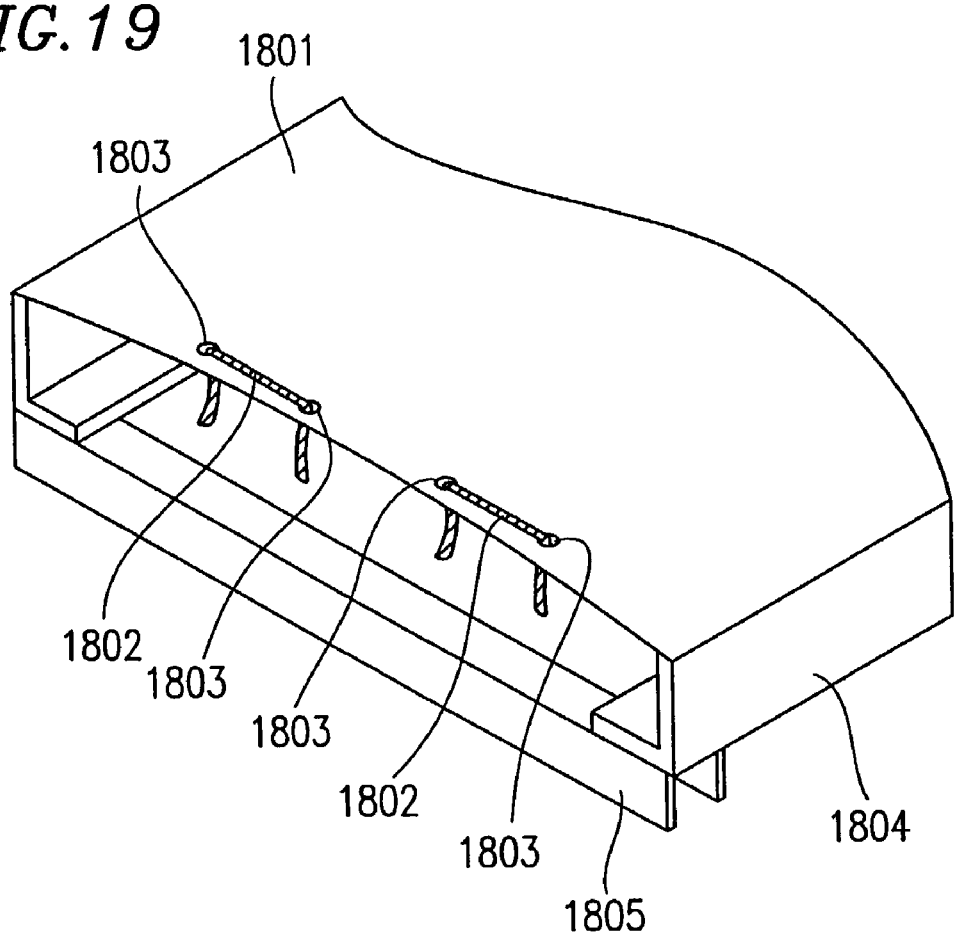
FIG. 19 is a schematic view of a damper in a cathode ray tube in Example 21.

FIG. 19 shows one example of a shadow mask 1801. When the shadow mask 1801 is used, it is effective to provide dampers 1802 for attenuating vibration of the shadow mask 1801 along both of two longer sides of the shadow mask 1801. Reference numeral 1804 represents a first shaft of the frame, and reference numeral 1805 represents a second shaft of the frame which is shorter than the first shaft 1804. For the sake of convenience, the elastic supports are not shown in FIG. 19.

Each damper 1802 is formed simply by making holes 1803 in the vicinity of the side of the shadow mask 1801 and inserting a wire through the holes 1803. It is preferable that the damper 1802 is formed of a material having a larger coefficient of thermal expansion than the material of the shadow mask 1801 since the temperature rise of the damper 1802 is slightly delayed from the temperature rise of the shadow mask 1801. In order to cause the damper 1802 to function effectively, it is necessary to make the vibration amplitude large at the four sides of the shadow mask 1801. In order to achieve this, the shadow mask 1801 preferably has a tension distribution which is largest in a central area of the shadow mask 1801 and becomes smaller towards the four sides of the shadow mask 1801.

In order to restrict the temperature rise in the mask 108, 808 shown respectively in FIGS. 1A, 8A, it is preferable to coat a surface of the mask 108, 808 facing the electron gun 114, 814 with a material having a sufficiently large mass number such as Bi (bismuth) or the like. In this case, a part of each of the electron beams which is not transmitted through the hole 107, 807 is reflected by the surface of the mask 108, 808, which effectively reduces doming.

As a cathode used for the electron gun 114, 814 (FIGS. 1A, 8A), a hot cathode is common. It is preferable to use an electric field electron emission element (cold cathode) for reducing the diameter of the electron beams in order to provide the effect of the present invention more noticeably for the following reason. When the diameter of the electron beams is smaller, an image having a higher resolution can be displayed. An image having a higher resolution requires a higher resistance against vibration and a higher resistance against the effects of dropping. With the structure of the conventional cathode ray tube, such a high resistance against vibration or the effects of dropping cannot be provided and degradation of color purity is inevitable. By contrast, a cathode ray tube according to the present invention has been confirmed not to cause degradation of color purity when external vibration is applied to the cathode ray tube or even the cathode ray tube in the case where the cold cathode is used. An electron source for the cold cathode may be, for example, a Spindt-type or tower-type electron source formed of Mo, Nb, W, Si, SiC or the like; an electron source formed of a carbon-based emitter including carbon nanotubes, graphite nanofibers, diamond, carbon fibers or the like; or an electron source formed of an emitter having a negative electron affinity formed of aluminum nitride (AlN) or the like.

As described above, according to a cathode ray tube of the present invention, degradation of color purity due to mislanding of the electron beams does not occur even when external vibration or strong impact is applied to the cathode ray tube.

INDUSTRIAL APPLICABILITY

The present invention provides an effect of providing a cathode ray tube which prevents degradation of color purity due to mislanding of the electron beams even when external vibration or strong impact is applied.

The invention claimed is:

1. A cathode ray tube, comprising:

an electron gun for emitting at least one electron beam;

a mask frame include a mask having a plurality of holes or slits for allowing the at least one electron beam to be transmitted therethrough and a frame to which the mask is attached; and a panel including a phosphor layer to be scanned by the at least one electron beam transmitted through the plurality of holes or slits of the mask, wherein:

the panel includes a plurality of stud pins for supporting the frame;

the frame includes a plurality of elastic supports engaged with the plurality of stud pins;

at least one of the plurality of elastic supports includes an engagement portion having an engaging hole which is engaged with one of the plurality of the stud pins and an elastic portion in contact with the one stud pin, wherein the at least one elastic support includes a fixing portion for fixing the at least one elastic support to the frame, and the elastic portion is fixed to the fixing portion, and the at least one elastic support further includes a connection portion for connecting the fixing portion and the engagement portion to each other; and mask frame vibration causes the elastic portion to rub against a respective stud pin so as to generate a frictional force for attenuating the vibration of the mask frame.

2. A cathode ray tube according to claim 1, wherein the one stud pin has a tip, and the elastic portion rubs against the tip of the one stud pin.

3. A cathode ray tube according to claim 1, wherein the elastic portion is formed of a metal plate rolled into a cylindrical shape.

4. A cathode ray tube according to claim 1, wherein the elastic portion is formed of a metal plate bent into a leaf spring-shape.

5. A cathode ray tube according to claim 1, wherein the fixing portion is provided between the engagement portion and the frame.

6. A cathode ray tube according to claim 5, wherein the elastic portion is provided between the engagement portion and the fixing portion.

7. A cathode ray tube according to claim 1, wherein a thickness of the fixing portion t0, a thickness of the connection portion t1 and a thickness of the elastic portion t2 satisfy the relationships of t0>t1 and t0>t2.

8. A cathode ray tube according to claim 1, wherein a thickness of the fixing portion t0, a thickness of the connection portion t1 and a thickness of the elastic portion t2 satisfy the relationships of t0>t1 and t1>t2.

9. A cathode ray tube according to claim 1, wherein each of the plurality of elastic supports has a substantially V-shaped cross-section.

10. A cathode ray tube according to claim 1, wherein each of the plurality of elastic supports has a substantially strip-like shape.

11. A cathode ray tube according to claim 1, wherein the at least one elastic support further includes a connection portion for connecting the fixing portion and the engagement portion to each other, and the elastic portion is fixed to the connection portion.

12. A cathode ray tube according to claim 1, wherein the elastic portion is fixed to the engagement portion.

13. A cathode ray tube according to claim 1, wherein the frame includes a pair of first shafts and a pair of second shafts shorter than the pair of first shafts, and the at least one elastic support is provided on at least one first shaft of the pair of first shafts.

14. A cathode ray tube according to claim 1, wherein the frame includes a pair of first shafts and a pair of second shafts shorter than the pair of first shafts, and the at least one elastic support is provided on at least one second shaft of the pair of second shafts.

15. A cathode ray tube according to claim 1, wherein the frame includes a plurality of corners, and the plurality of elastic supports are provided at respective corners.

16. A cathode ray tube according to claim 1, wherein the mask includes a damper provided at an end thereof for attenuating the vibration of the mask.

17. A cathode ray tube according to claim 1, wherein the electron gun includes an electric field electron emission element for reducing a cross-section of the at least one electron beam.

18. A cathode ray tube according to claim 1, wherein the at least one elastic support has a bimetal structure including a first metal area formed of a first metal having a first coefficient of thermal expansion and a second metal area formed of a second metal having a second coefficient of thermal expansion which is less than the first coefficient of thermal expansion, the first metal area and the second metal being joined together.

19. A cathode ray tube according to claim 18, wherein the first metal area formed of the first metal has a greater longitudinal size than a longitudinal size of the second metal area formed of the second metal.

20. A cathode ray tube according to claim 18, wherein the first metal includes stainless steel, and the second metal includes nickel steel.

21. An image display apparatus including a cathode ray tube according to claim 1.

22. A cathode ray tube, comprising:

an electron gun for emitting at least one electron beam;

a mask frame include a mask having a plurality of holes or slits for allowing the at least one electron beam to be transmitted therethrough and a frame to which the mask is attached; and a panel including a phosphor layer to be scanned by the at least one electron beam transmitted through the plurality of holes or slits of the mask, wherein:

the panel includes a plurality of stud pins for supporting the frame;

the frame includes a plurality of elastic supports engaged with the plurality of stud pins;

at least one of the plurality of elastic supports includes an engagement portion having an engaging hole which is engaged with one of the plurality of stud pins;

the engagement portion includes a plurality of sliding pieces forming a funnel shape provided in the engaging hole; and mask frame vibration causes a surface of each of the plurality of sliding pieces to rub against a respective stud pin so as to generate a frictional force for attenuating the vibration of the mask frame.

23. A cathode ray tube according to claim 22, wherein the at least one elastic support includes a fixing portion for fixing the at least one elastic support to the frame, and a connection portion for connecting the fixing portion and the engagement portion.

24. A cathode ray tube according to claim 23, wherein the sliding piece has a length of about 0.5 mm or more and about 2.5 mm or less.

25. A cathode ray tube according to claim 22, wherein each of the plurality of elastic supports has a substantially strip-like shape.

26. A cathode ray tube according to claim 22, wherein the mask includes a damper provided at an end thereof for attenuating the vibration of the mask.

27. A cathode ray tube according to claim 22, wherein the electron gun includes an electric field electron emission element for reducing a cross-section of the at least one electron beam.

28. An image display apparatus including a cathode ray tube according to claim 22.

29. A cathode ray tube, comprising:

an electron gun for emitting at least one electron beam;

a mask frame include a mask having a plurality of holes or slits for allowing the at least one electron beam to be transmitted therethrough and a frame to which the mask is attached; and a panel including a phosphor layer to be scanned by the at least one electron beam transmitted through the plurality of holes or slits of the mask, wherein:

the panel includes a plurality of stud pins for supporting the frame;

the frame includes a plurality of elastic supports engaged with the plurality of stud pins;

at least one of the plurality of elastic supports includes an engagement portion having an engaging hole which is engaged with one of the plurality of stud pins;

the engagement portion includes a central portion having the engaging hole, a first side portion separated from the central portion by a first cut, and a second side portion separated from the central portion by a second cut formed on an opposite side to the first cut with respect to the central portion;

mask frame vibration causes a cut sectional face of the central portion facing the first cut to rub against a cut sectional face of the first side portion so as to generate a frictional force for attenuating the vibration of the mask frame; and mask frame vibration further causes another cut sectional face of the central portion facing the second cut to rub against a cut sectional face of the second side portion so as to generate a frictional force for attenuating the vibration of the mask frame.

30. A cathode ray tube according to claim 29, wherein the at least one elastic support includes a fixing portion for fixing the at least one elastic support to the frame, and a connection portion for connecting the fixing portion and the engagement portion to each other.

31. A cathode ray tube according to claim 29, wherein each of the plurality of elastic supports has a substantially V-shaped cross-section.

32. A cathode ray tube according to claim 29, wherein the mask includes a damper provided at an end thereof for attenuating the vibration of the mask.

33. A cathode ray tube according to claim 29, wherein the electron gun includes an electric field electron emission element for reducing a cross-section of the at least one electron beam.

34. An image display apparatus including a cathode ray tube according to claim 29.

35. A cathode ray tube, comprising:

an electron gun for emitting at least one electron beam;

a mask frame including a mask having a plurality of holes or slits for allowing the at least one electron beam to be transmitted therethrough and a frame to which the mask is attached; and a panel including a phosphor layer to be scanned by the at least one electron beam transmitted through the plurality of holes or slits of the mask, wherein:

the panel includes a plurality of stud pins for supporting the frame:

the frame includes a plurality of elastic supports engaged with the plurality of stud pins;

at least one of the plurality of elastic supports includes an engagement portion having an engaging hole which is engaged with one of the plurality of stud pins and a fixing portion for fixing the at least one elastic support to the frame;

the fixing portion includes a first bent portion and a second bent portion bent towards the engagement portion;

the first bent portion has a fifth bent portion for restricting the engagement portion from moving in a direction away from the fixing portion, and the second bent portion has a sixth bent portion for restricting the engagement portion from moving towards the fixing portion, the engagement portion includes a third bent portion bent so as to be in contact with the first bent portion and a fourth bent portion bent so as to be in contact with the second bent portion;

mask frame vibration causes the first bent portion to rub against the third bent portion so as to generate a frictional force for attenuating the vibration of the mask frame; and the mask frame vibration further causes the second bent portion to rub against the fourth bent portion so as to generate a frictional force for attenuating the vibration of the mask frame.

36. A cathode ray tube according to claim 35, wherein the at least one elastic support further includes a connection portion for connecting the fixing portion and the engagement portion to each other.

37. A cathode ray tube according to claim 35, wherein each of the plurality of elastic supports has a substantially V-shaped cross-section.

38. A cathode ray tube according to claim 35, wherein the frame includes a plurality of corners, and the plurality of elastic supports are provided at respective corners.

39. A cathode ray tube according to claim 35, wherein the frame includes a pair of first shafts and a pair of second shafts shorter than the pair of first shafts, and the at least one elastic support is provided on at least one first shaft of the pair of first shafts.

40. A cathode ray tube according to claim 35, wherein the frame includes a pair of first shafts and a pair of second shafts shorter than the pair of first shafts, and the at least one elastic support is provided on at least one second shaft of the pair of second shafts.

41. A cathode ray tube according to claim 35, wherein the mask includes a damper provided at an end thereof for attenuating the vibration of the mask.

42. A cathode ray tube according to claim 35, wherein the electron gun includes an electric field electron emission element for reducing a cross-section of the at least one electron beam.

43. An image display apparatus including a cathode ray tube according to claim 35.

44. A cathode ray tube, comprising:

an electron gun for emitting at least one electron beam;

a mask frame include a mask having a plurality of holes or slits for allowing the at least one electron beam to be transmitted therethrough and a frame to which the mask is attached; and a panel including a phosphor layer to be scanned by the at least one electron beam transmitted through the plurality of holes or slits of the mask, wherein:

the panel includes a plurality of stud pins for supporting the frame;

the frame includes a plurality of elastic supports engaged with the plurality of stud pins;

at least one of the plurality of elastic supports includes an engagement portion having an engaging hole which is engaged with one of the plurality of stud pins and an elastic portion in contact with the engagement portion, wherein the at least one elastic support includes a fixing portion for fixing the at least one elastic support to the frame, and the elastic portion is fixed to the fixing portion, and the at least one elastic support further includes a connection portion for connecting the fixing portion and the engagement portion to each other; and mask frame vibration causes the elastic portion to rub against the engagement portion so as to generate a frictional force for attenuating the vibration of the mask frame.

45. A cathode ray tube according to claim 44, wherein the elastic portion is provided on each of both sides of the engaging hole.

46. A cathode ray tube according to claim 44, wherein the elastic portion is a metal plate rolled into a cylindrical shape.

47. A cathode ray tube according to claim 44, wherein the elastic portion is formed of a metal plate bent into a leaf spring-shape.

48. A cathode ray tube according to claim 44, wherein each of the plurality of elastic supports has a substantially V-shaped cross-section.

49. A cathode ray tube according to claim 44, wherein the mask includes a damper provided at an end thereof for attenuating the vibration of the mask.

50. A cathode ray tube according to claim 44, wherein the electron gun includes an electric field electron emission element for reducing a cross-section of the at least one electron beam.

51. An image display apparatus including a cathode ray tube according to claim 44.

* * * * *

UNITED STATES PATENT AND TRADEMARK OFFICE

CERTIFICATE OF CORRECTION

PATENT NO. : 7,023,129 B1
APPLICATION NO. : 10/111264
DATED : April 4, 2006
INVENTOR(S) : Koji Akiyama et al.

It is certified that error appears in the above-identified patent and that said Letters Patent is hereby corrected as shown below:

Column 1, line 49, please amend "taken along line A-A in FIG. 1" to --taken along line A-A in FIG. 20A--.

Figure 21A:
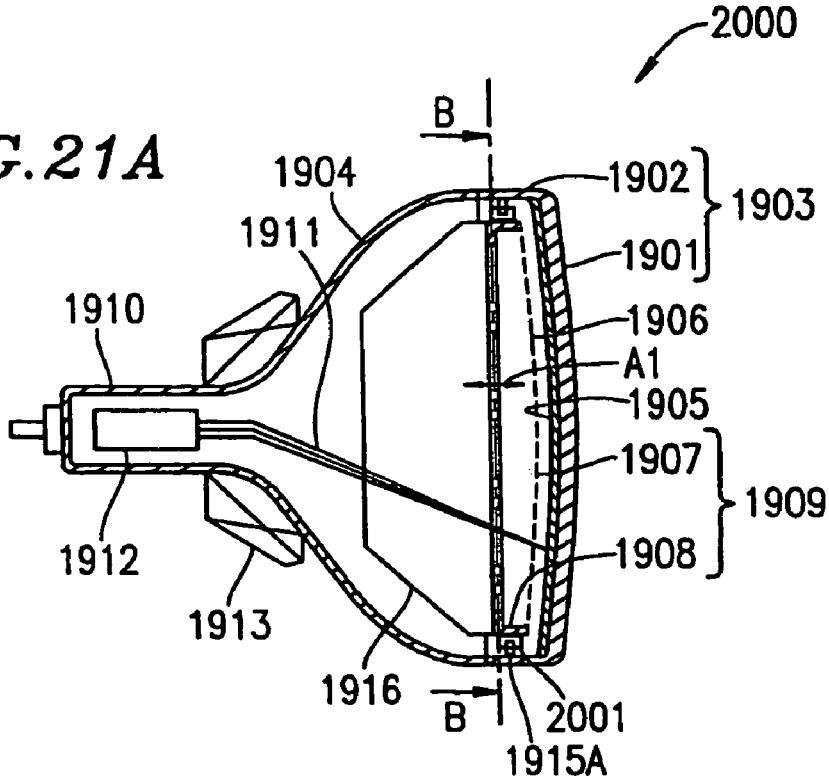
PRIOR ART FIG. 21A
FIG. 21A is a schematic view of another conventional cathode ray tube.
Figure 21B:
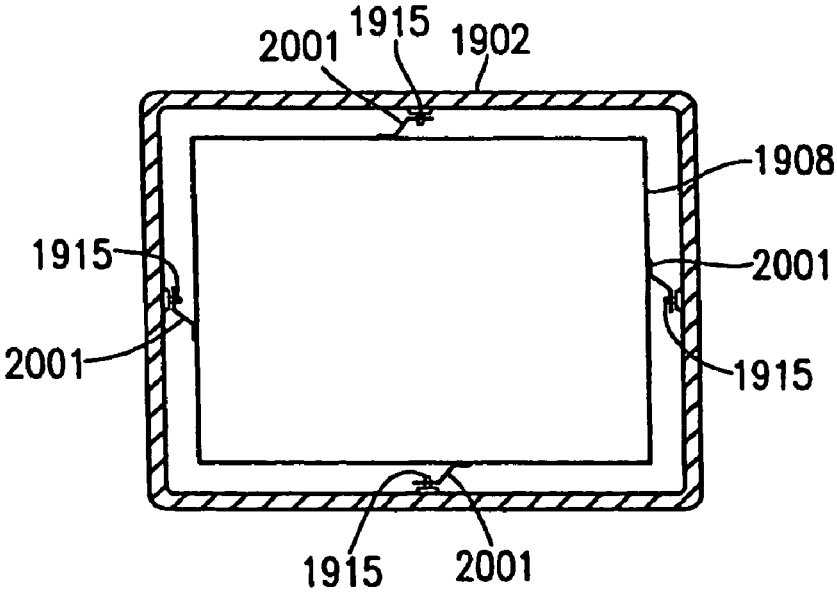
PRIOR ART FIG. 21B
FIG. 21B shows a mask frame supporting device shown in FIG. 21A.

Column 1, line 60, please amend "shown in FIG. 20A" to --shown in FIG. 21A--

Signed and Sealed this

Twenty-first Day of November, 2006

JON W. DUDAS
*Director of the United States Patent and Trademark Office*